US012037756B2

(12) United States Patent
Neusch

(10) Patent No.: US 12,037,756 B2
(45) **Date of Patent: *Jul. 16, 2024**

(54) POST AND BEAM VEHICLE BARRIER

(71) Applicant: Neusch Innovations, LP, Burnet, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/217,402

(22) Filed: Jun. 30, 2023

(65) Prior Publication Data

US 2024/0076841 A1 Mar. 7, 2024

Related U.S. Application Data

(63) Continuation of application No. 17/549,687, filed on Dec. 13, 2021, now Pat. No. 11,781,275, and a continuation of application No. 17/516,665, filed on Nov. 1, 2021, now Pat. No. 11,795,640, said application No. 17/549,687 is a continuation of application No. 16/224,544, filed on Dec. 18, 2018, now Pat. No. 11,198,980, said application No. 17/516,665 is a continuation of application No. 16/167,260, filed on Oct. 22, 2018, now Pat. No.

(Continued)

(51) Int. Cl.
*E01F 13/12* (2006.01)

(52) U.S. Cl.
CPC ..... *E01F 13/12* (2013.01)

(58) Field of Classification Search
None
See application file for complete search history.

(56) References Cited

U.S. PATENT DOCUMENTS 654,190 A * 7/1900 Thompson ..... A01K 1/0023 256/13
1,222,020 A 4/1917 Myers
(Continued)

FOREIGN PATENT DOCUMENTS

DE 4031781 A1 4/1991
DE 4335904 A1 5/1995
(Continued)

OTHER PUBLICATIONS

Ameristar Stallwart, M40 P2 Post and Rail; dated May 5, 2015.
(Continued)

*Primary Examiner* — Thomas B Will
*Assistant Examiner* — Katherine J Chu
(74) *Attorney, Agent, or Firm* — Bradley Arant Boult Cummings LLP; Henry L. Ehrlich

(57) ABSTRACT

A vehicle barrier includes a first post and a second post each having a top end and a planar wall, a barrier beam extending longitudinally in a same vertical plane as the first post and the second post and the barrier beam separating an attack side from an asset side, a first post connection attaching the barrier beam to the first post, the first post connection comprising a first beam plate extending from a first end of the barrier beam, a first post plate extending from the planar wall of the first post, and a first pin vertically disposed in the first beam plate and the first post plate, and a second post connection attaching the barrier beam to the second post.

24 Claims, 16 Drawing Sheets

Related U.S. Application Data

11,162,234, which is a continuation of application No. 15/135,400, filed on Apr. 21, 2016, now Pat. No. 10,106,939.

(60) Provisional application No. 62/607,245, filed on Dec. 18, 2017, provisional application No. 62/165,163, filed on May 21, 2015, provisional application No. 62/151,370, filed on Apr. 22, 2015.

(56) References Cited

U.S. PATENT DOCUMENTS 1,633,659 A 6/1927 Cerny
1,658,118 A 2/1928 Doddridge
1,749,190 A 3/1930 McGregor
1,793,676 A 2/1931 Camp
1,826,998 A 10/1931 Doddridge
1,848,246 A 3/1932 Dowell
1,849,167 A 3/1932 Bente
1,913,715 A 6/1933 MacDonald
1,922,878 A 8/1933 Boyle
1,956,767 A 5/1934 Kibler
2,039,879 A * 5/1936 Brown ..... E04H 17/1413 256/68
2,073,947 A 3/1937 Sander
2,101,176 A 12/1937 Height
2,123,167 A 7/1938 Cain
2,172,919 A 9/1939 Wertman
2,227,958 A 1/1941 Camp
2,265,698 A 12/1941 Opgenorth
2,296,432 A 9/1942 Ferguson
2,326,547 A * 8/1943 McNabb ..... E01F 15/06 403/275
2,777,227 A 1/1957 Frank
3,039,743 A * 6/1962 Aronco ..... E01F 15/0446 D25/42
3,210,051 A 10/1965 Case
3,258,250 A 6/1966 McMulliin
3,332,666 A 7/1967 Harvey
3,390,865 A 7/1968 Jamesr
3,417,965 A 12/1968 Gray
3,447,786 A 6/1969 Bigni
3,589,681 A 6/1971 Ackerman
3,726,750 A 4/1973 Stillings
3,784,167 A 1/1974 Glaesener
3,848,854 A 11/1974 De Barbieri
4,071,223 A 1/1978 Demarest
4,174,096 A 11/1979 Campbell
4,208,038 A 6/1980 Reid
4,214,411 A 7/1980 Pickett
4,474,503 A 10/1984 Booth et al.
4,739,971 A 4/1988 Ruane
4,778,250 A 10/1988 Mcroskey et al.
4,784,515 A 11/1988 Krage et al.
4,806,044 A 2/1989 Duckett
4,828,425 A * 5/1989 Duckett ..... E01F 15/006 16/361
4,930,752 A 6/1990 Wolper, Jr.
4,979,817 A 12/1990 Crisp, Sr.
5,044,609 A 9/1991 Cicinnati et al.
5,292,096 A 3/1994 Bodenheimer
5,649,396 A * 7/1997 Carr ..... E01F 13/06 49/34
5,657,966 A 8/1997 Cicinnati
5,664,905 A 9/1997 Thompson et al.
5,695,174 A 12/1997 Tsai
5,720,470 A 2/1998 Johansson
6,059,487 A 5/2000 Haga et al.
6,203,242 B1 3/2001 Englund
6,237,895 B1 5/2001 Thurston
6,254,063 B1 7/2001 Rohde et al.
6,272,796 B1 8/2001 Metzler
6,290,427 B1 9/2001 Ochoa
6,398,192 B1 6/2002 Albritton
6,413,009 B1 7/2002 Duckett
6,485,224 B1 11/2002 Dyke et al.
6,488,268 B1 12/2002 Albritton
6,533,249 B2 3/2003 Ochoa
6,551,011 B1 4/2003 Valentine
6,644,888 B2 11/2003 Ochoa
6,666,616 B2 12/2003 Yodock, III et al.
6,712,545 B2 3/2004 Muller et al.
6,729,607 B2 5/2004 Alberson et al.
6,783,116 B2 8/2004 Albritton
6,802,496 B1 10/2004 Preta
6,843,613 B2 1/2005 Gelfand et al.
6,932,327 B2 8/2005 Alberson et al.
7,063,186 B1 6/2006 Granke
7,144,186 B1 12/2006 Nolte
7,249,909 B2 7/2007 Bibber
7,367,549 B2 5/2008 Titmus
7,530,548 B2 5/2009 Ochoa
7,544,009 B2 6/2009 Bergendahl et al.
7,581,351 B2 9/2009 Lewis
7,654,768 B1 * 2/2010 Tullis ..... E01F 15/083 404/6
7,794,173 B2 9/2010 Amengual Pericas
7,866,106 B2 1/2011 Bowlware
7,866,913 B2 1/2011 Kulp et al.
7,878,485 B2 2/2011 Conway et al.
7,913,981 B2 3/2011 Rohde et al.
7,950,870 B1 5/2011 Thompson et al.
7,977,834 B2 7/2011 Park et al.
7,988,133 B2 8/2011 Gripne et al.
7,997,824 B2 8/2011 Amengual Pericas
8,001,880 B2 8/2011 White et al.
8,033,053 B2 10/2011 Anderson et al.
8,083,433 B2 12/2011 Neusch
8,127,419 B2 3/2012 Calton et al.
8,210,767 B1 7/2012 Swahlan et al.
8,235,359 B2 8/2012 Dyke et al.
8,439,594 B1 5/2013 Clark et al.
8,517,349 B1 8/2013 Ross et al.
8,596,617 B2 12/2013 James
8,875,440 B1 * 11/2014 Duran ..... E04H 17/14 49/34
8,992,116 B2 * 3/2015 Sloan ..... E04H 17/127 404/6
9,347,191 B2 5/2016 Kemper et al.
9,410,298 B2 8/2016 Kemper et al.
9,428,872 B2 8/2016 Neusch
9,435,088 B2 9/2016 Kemper et al.
9,500,000 B2 11/2016 Mccarty et al.
9,644,393 B2 5/2017 Mccue et al.
9,719,220 B2 8/2017 Neusch
10,047,488 B2 8/2018 Leonhard
10,208,430 B1 2/2019 Lawler et al.
10,767,325 B2 9/2020 Humphries et al.
2003/0081997 A1 5/2003 Kramer
2003/0089066 A1 5/2003 Nelson
2003/0146426 A1 8/2003 Ray et al.
2005/0191125 A1 9/2005 Albritton
2005/0199868 A1 9/2005 Morris
2006/0002760 A1 1/2006 Vellozzi et al.
2006/0011900 A1 1/2006 Ochoa
2006/0033093 A1 2/2006 Lo
2007/0102689 A1 5/2007 Alberson et al.
2008/0131200 A1 6/2008 Winkler et al.
2008/0296546 A1 12/2008 Bergendahl
2010/0288989 A1 11/2010 Williams et al.
2012/0056143 A1 3/2012 James
2012/0207541 A1 8/2012 Maus et al.
2012/0241702 A1 9/2012 James
2013/0207060 A1 8/2013 Tonks et al.
2014/0110651 A1 4/2014 Cox et al.
2014/0212214 A1 7/2014 Sloan et al.
2015/0346060 A1 12/2015 Simon et al.
2016/0017555 A1 1/2016 Kemper et al.
2016/0053449 A1 2/2016 Kemper et al.
2016/0115661 A1 4/2016 Neusch
2016/0230358 A1 8/2016 Kemper et al.
2016/0312418 A1 10/2016 Neusch
2018/0327985 A1 11/2018 Lawler

(56) References Cited

U.S. PATENT DOCUMENTS

| | | | | |
|---|---|---|---|---|
| 2019/0010727 | A1 | 1/2019 | Messelis | |
| 2019/0063020 | A1 | 2/2019 | Neusch | |
| 2019/0085589 | A1 | 3/2019 | McKinney | |
| 2019/0186092 | A1 | 6/2019 | Neusch | |
| 2019/0257110 | A1 | 8/2019 | Powers, III | |
| 2021/0115635 | A1 | 4/2021 | Delot | |
| 2021/0189671 | A1* | 6/2021 | Ball | E01F 13/12 |
| 2023/0374816 | A1* | 11/2023 | Beausoleil | E04H 17/017 |

FOREIGN PATENT DOCUMENTS

| | | | |
|---|---|---|---|
| EP | 0369659 | A1 | 5/1990 |
| FR | 2542356 | A1 * | 9/1984 |
| GB | 2224529 | A | 5/1990 |
| GB | 2481647 | A | 1/2012 |
| GB | 2588223 | A | 4/2021 |

OTHER PUBLICATIONS

Ameristar Stallwart, K12 Post and Rail; dated May 4, 2015.
Ameristar Stallwart, M50-P1 Single Run Layout; dated May 4, 2015.
ASTM Designation F 2656-07, Standard Test Method for Vehicle Crash Testing of Perimeter Barriers.
Baker, Personnel-Vehicle Type 2A, Nov. 4, 2007.
Baker, Vehicle Fence Type 1 Gate, Apr. 3, 2008.
Baker, Vehicle Fence Type 1, Apr. 21, 2008.
Stallwart, Post & Rail Anti-Ram Crash Barrier; Ameristar Fence Products; Jun. 2014.
U.S. Dept. of State, DS-41 K-4 Anti-Ram Fence Details, Feb. 4, 2010.

* cited by examiner

POST AND BEAM VEHICLE BARRIER

BACKGROUND

This section provides background information to facilitate a better understanding of the various aspects of the disclosure and is not an admission of prior art.

Vehicle barrier systems are used to prevent vehicles from entering a predetermined location. Anti-ram vehicle barriers (AVB) systems or vehicle security barriers (VSB) are configured to stop motor vehicles, such as trucks, that are intentionally crashed into the barrier in an attempt to breach the barrier and enter the protected area for nefarious purposes. Passive barriers are static after installation and deployment, in other words, passive AVBs "never" allow vehicular access to certain areas, while active AVBs (e.g., gates, drop arms, active wedges) control or limit vehicular access to a particular area.

Some anti-ram vehicle barriers are crash tested to ensure compliance with and obtain certification from a recognized standard. For example, the American Standard Test Method (ASTM F2656 Standard Test Method for Vehicle Crash Testing of Perimeter Barriers), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb. (6800 kg) and the nominal velocities were 30 mph (50 km/hr.), 40 mph (65 km/hr.) and 50 mph (80 km/hr.). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and a heavy goods truck. ASTM F2656-07 maintained three predetermined impact velocities for each vehicle category and penetration is measured from the rear face of the barrier and classified into four categories of penetration rating. The penetration ratings include P1 for less than or equal to 1 meter (3.3 ft.); P2 for 1.10 to 7 m (3.31 to 23.0 ft.); P3 for 7.01 to 30 m (23.1 to 98.4 ft.); and P4 for 30 m (98 ft.) or greater. ASTM F2656 was revised in 2015 (ASTM F2656-15) to include two additional vehicle types, a full-sized sedan and a cab over/cab forward class 7 truck and it excluded the lowest penetration rating (P4).

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a 5-to-7-part classification code, the includes: Classification of Test/Gross Weight of Vehicle (kgs) (Vehicle Class)/Impact Speed/Angle of Impact: Distance Leading Edge of Load Bay travels beyond the Original Position of Rear Face/Dispersion Distance of major debris weighing 25 kg or more from the barrier to establish stand-off distance. For example, a barrier (bollard) tested by impact by a 7500 kg day cab ("V") at a ninety-degree angle traveling 80 km/hr. and resulting in penetration of 7.5 m with significant debris scattered up to 20.0 m away would be designated as V/7500(N3)/80/90:7.5/20.0. The dispersion distance can be used to determine a stand-off distance for example to mitigate damage from a vehicle born improvised explosive device (VBIED).

The European Committee for Standardization (CEN), recognized across 34 European countries, has produced a standard CWA 16221 that combines details of BS PAS 68 and PAS 69. PAS 69 provides guidance on the barrier's use and installation.

The 2013 International Works Agreement (IWA) 14-1: 2013 provides an international specification for crash-testing. The system was developed by government agencies, military bodies and providing companies from the USA, UK, Germany, Norway, Oman, Singapore and Syria. This standard includes a merging of vehicle impact test specifications of the British PAS 68 and the American ASTM F2656. This international standard assesses vehicle barrier performance based on nine types of test vehicles with up to seven test speeds. Penetration is measured from the front (attack side) face of the VSB. The IWA 14 classification code represents Vehicle Impact Test/Gross Weight of Vehicle (Vehicle Class)/Impact Speed/Angle of Impact/Penetration beyond the original position of the Front/Impact face.

SUMMARY

An exemplary beam-to-post connection in a vehicle barrier includes an upstanding post having a top end and a planar wall, a barrier beam extending longitudinally in a same vertical plane as the post and separating an attack side from an asset side, a first beam section of the barrier beam attached to the post on a first side of the post by a first post connection, the first post connection comprising a first beam plate extending from an end of the first beam section, a first post plate extending from the planar wall proximate the top end, and a first pin vertically disposed in the first beam plate and the first post plate, a second beam section of the barrier beam attached to the post on a second side of the post by a second post connection, and the second post connection comprising a second beam plate extending from an end of the second beam section, a second post plate extending from the planar wall proximate the top end, and a second pin vertically disposed in the second beam plate and the second post plate.

An exemplary vehicle barrier includes a first post and a second post each having a top end and a planar wall, a barrier beam extending longitudinally in a same vertical plane as the first post and the second post and the barrier beam separating an attack side from an asset side, a first post connection attaching the barrier beam to the first post, the first post connection comprising a first beam plate extending from a first end of the barrier beam, a first post plate extending from the planar wall of the first post, and a first pin vertically disposed in the first beam plate and the first post plate, and a second post connection attaching the barrier beam to the second post.

Another exemplary vehicle barrier includes a first post and a second post each having a top end, an attack-side wall, an asset-side wall, and a planar wall connecting the attack-side wall and the asset-side wall, a barrier beam extending longitudinally in a same vertical plane as the first post and the second post, the barrier beam separating an attack side from an asset side, and the barrier beam comprising a central web extending connecting an attack-side flange and an asset-side flange, a first post connection attaching the barrier beam to the first post, the first post connection comprising a first beam plate and a first lower beam plate extending from a first end of the barrier beam, a first post plate extending from the planar wall proximate the top end of the first post and positioned between the first beam plate and the first lower beam plate, and a first pin vertically disposed in the first beam plate, the first post plate, and the first lower beam plate, and a second post connection attaching the barrier beam to the second post.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
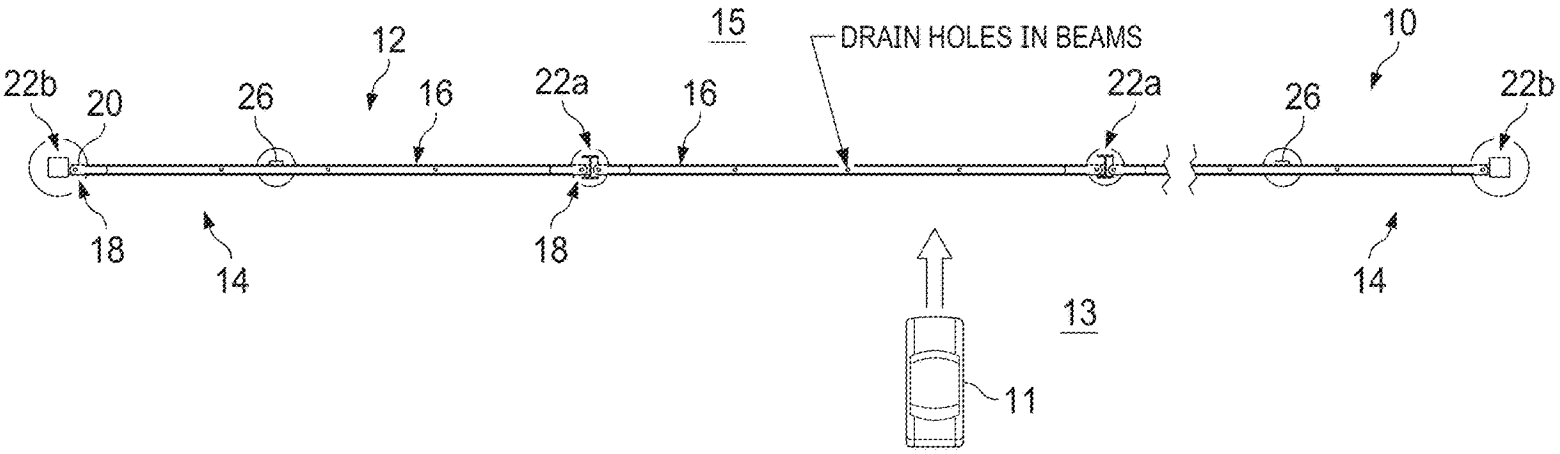
FIG. 1 is a plan view of a longitudinally extending section of an exemplary anti-ram vehicle barrier according to aspects of the disclosure.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

Embodiments of the disclosed anti-ram vehicle barrier 10 are configured to be crash-rated by certifying agencies such as DOD, DOS, American Standard Test Method (ASTM), British Standards Institution (BSI) and International Standardization Institution (ISO). Vehicle barriers are tested by crashing a motor vehicle from an attack side in a perpendicular direction into the barrier. The vehicle barrier is rated based on the test vehicles weight, the speed of impact, and the penetration of the vehicle (e.g., the cargo bed) beyond the pre-impact inside edge of the barrier. For example, a "K" (SD-STD-02.01) or "M" (ASTM F2656) designates a medium duty vehicle with a gross weight of 15,000 pounds (6810 kg). The speed ratings include K4/M30 for traveling at 28.0 to 37.9 miles per hour (mph); K8/M40 traveling at 38.0 to 46.9 mph, and K12/M50 traveling at 47.0 mph and above. The penetration ratings include P1 for less than or equal to 1 meter (3.3 ft.); P2 for 1.10 to 7 m (3.31 to 23.0 ft.); and P3 for 7.01 to 30 m (23.1 to 98.4 ft.). For example, an M50-P1 crash barrier is designed to stop a medium duty truck traveling 50 mph with a penetration distance of 3.3 feet or less. Some embodiments of the disclosed anti-ram vehicle barrier 10 may be engineered crash-rated but not crash tested. Some embodiments of the disclosed anti-ram vehicle barrier 10 may not be engineered crash-rated or crash tested.

Figure 2:
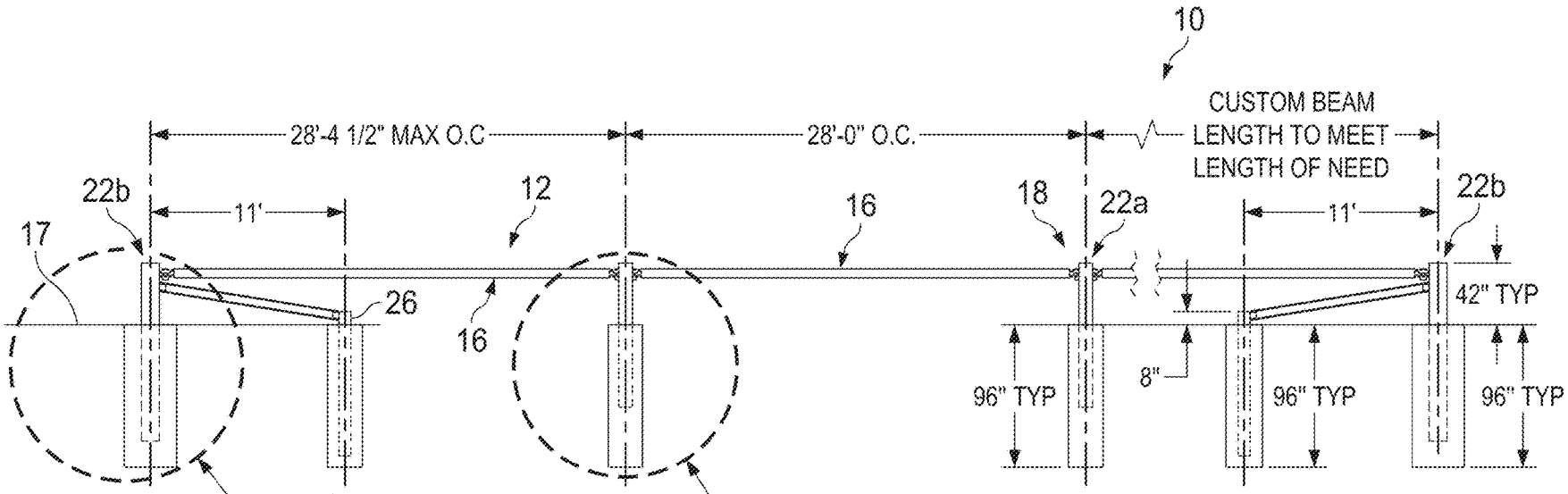
FIG. 2 is an elevation view of a portion of the exemplary anti-ram vehicle barrier of FIG. 1.
Figure 3:
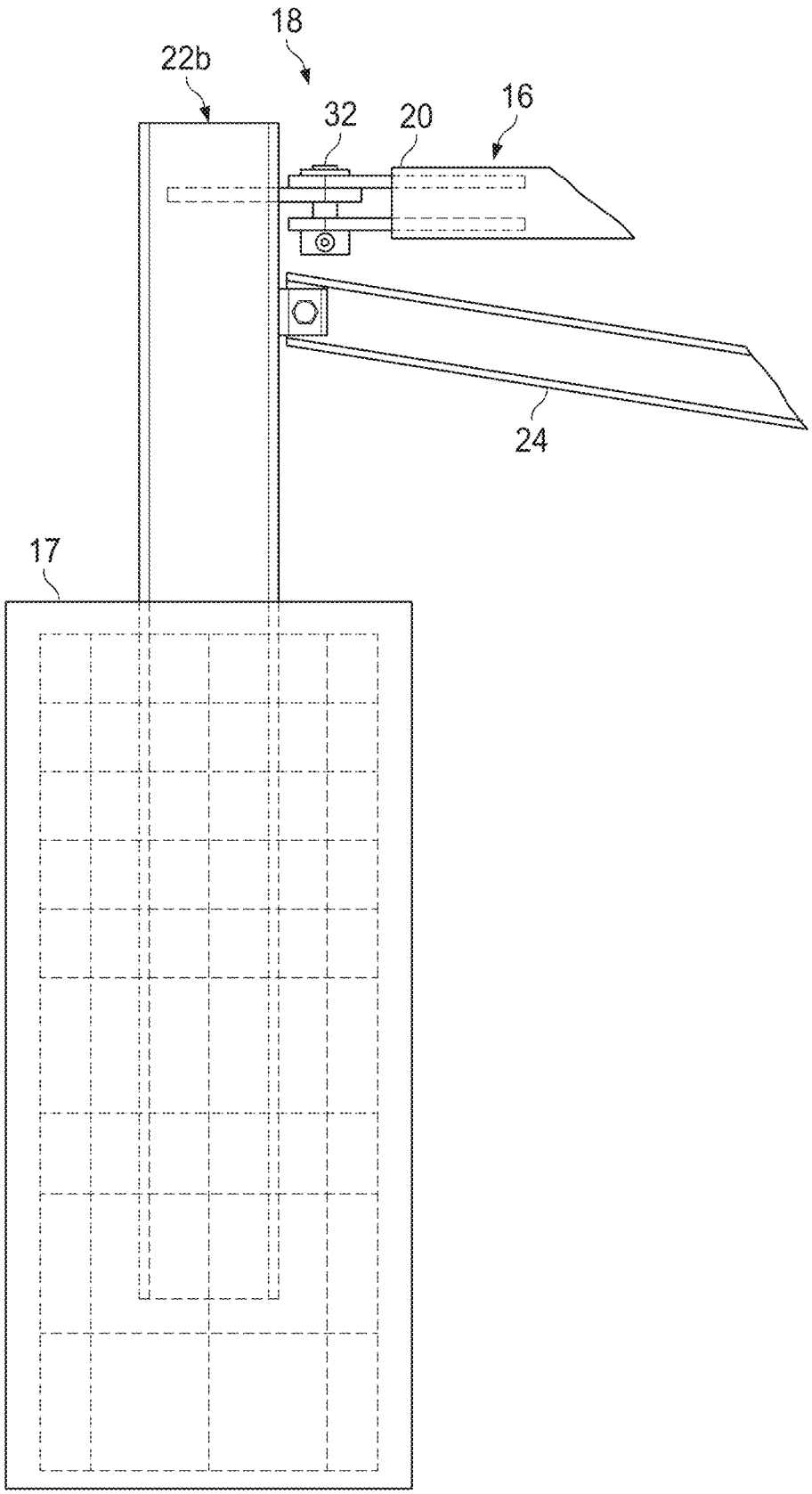
FIG. 3 illustrates an exemplary end post to beam connection according to aspects of the disclosure.

FIG. 1 is a plan view of an exemplary passive anti-ram vehicle barrier (AVB), generally denoted by the numeral 10, arranged in a post and beam arrangement according to aspects of the disclosure. FIG. 2 is an elevation view of passive anti-ram vehicle barrier 10 illustrated in FIG. 1. AVB 10 is configured to stop a motor vehicle 11 traveling from an attack side 13 that crashes into AVB 10 from penetrating beyond a selected distance from AVB 10 into the protected or asset side 15. In a post and beam arrangement, braces are not used to achieve an anti-ram vehicle barrier rating. FIGS. 1 and 2 illustrate an embodiment configured to meet the crash criteria to achieve an M50-P1 rating under ASTM F2656 or a similar rating.

In FIG. 1, AVB 10 is positioned between a protected or asset side 15 and a motor vehicle 11 approaching AVB 10 from an attack side 13. AVB 10 includes a continuous beam 12 positioned above ground level 17. AVB 10 may include one or more truss sections 14. In the illustrated examples, truss sections 14 are illustrated at the terminal ends of a longitudinal length of continuous beam 12. It will be recognized by those skilled in the art with the benefit of this disclosure, that two or more longitudinal lengths of continuous beam 12 may be arranged together to form an extended length of need. Beam 12 is formed of interconnected beam sections 16. Adjacent beams sections 16 are connected at joints 18. In some embodiments, joints 18 are pivoting connections that permit a degree of pivoting movement between adjacent beam sections 16 or a beam section and a post when beam 12 is impacted by a motor vehicle.

Posts, generally denoted by the numeral 22, are connected to beam 12, for example, to support beam 12 above ground level and to provide tension to mitigate lift of beam 12 in response to the impact of the motor vehicle. Posts 22 are metal members and may take various forms including I-beams, round or rectangular (e.g., square) members. Posts 22 may be arranged in a line or crash post configuration, identified specifically with reference number 22*a*, connected to beam 12 at a joint 18 and between adjacent beam sections. In a post and beam arrangement, braces do not extend from a crash post to the ground in the direction toward asset side 15. Posts 22 may be arranged in an end or corner post configuration, identified specifically with the reference number 22*b*, connected to continuous beam 12 at a joint 18. Posts 22 may be arranged in an intermediate configuration, identified specifically with reference number 22*c* (see, e.g., FIGS. 14-15), connected directly to beam 12 at an intermediate position between joints 18. Some or all of posts 22 may be used to support an ornamental fence structure, e.g., a chain link section.

Crash posts 22*a* and end posts 22*b* provide the structural strength in a post and beam arrangement to resist vehicle penetration to meet standardized test criteria. In some embodiments, crash posts 22*a* and end posts 22*b* are in the same vertical plane as beam 12. Intermediate posts 22*c* are located within the beam span between joints 18 that connect adjacent beam sections 16 or beams sections 16 to crash posts 22*a* or end posts 22*b*. Intermediate posts 22*c* may be connected to the beam, for example, to provide vertical support to beam 12 between relatively long spans between crash posts and to provide tension to the beam relative to the foundation to prevent lift of the beam when impacted by a vehicle. AVB 10 illustrated in FIGS. 1 and 2 does not have intermediate posts due to the short span between the adjacent crash posts 22*a*.

Figure 4:
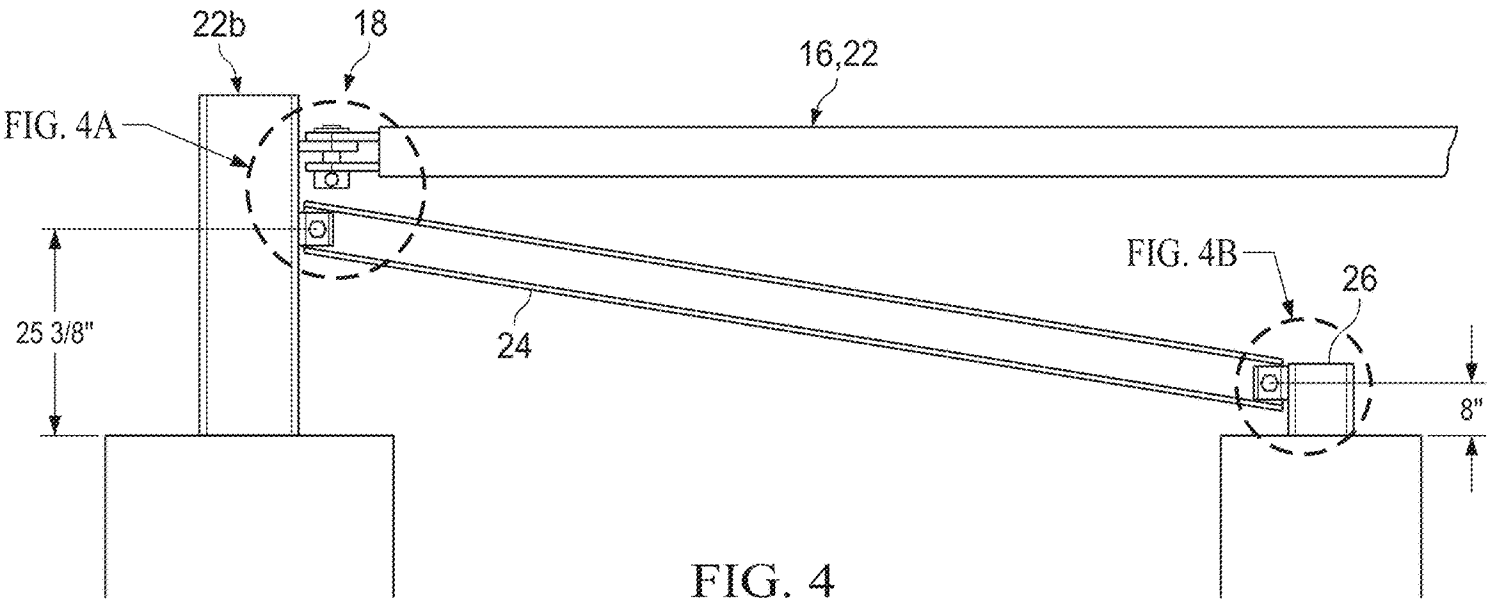
FIG. 4 illustrates an exemplary truss section according to aspects of the disclosure.
Figure 4B:
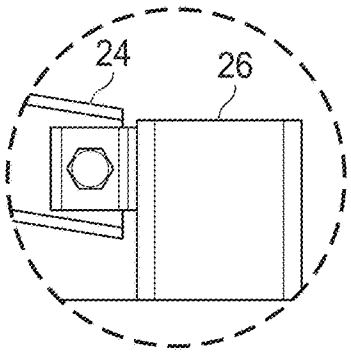
FIG. 4B is an expanded view of a portion of the truss section of FIG. 4.
Figure 5:
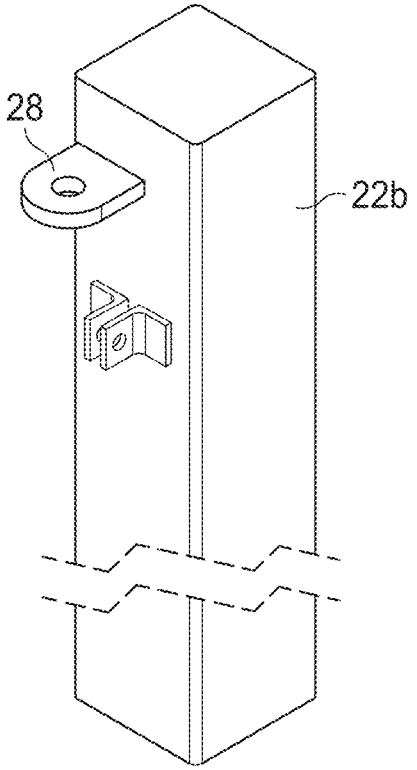
FIG. 5 is a perspective view of an exemplary end post according to aspects of the disclosure.
Figure 6:
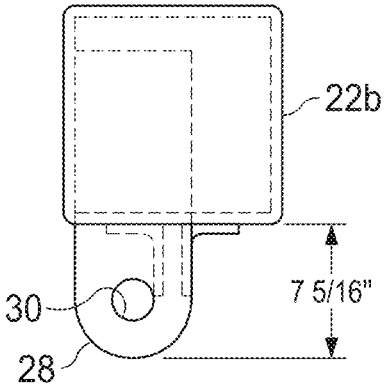
FIG. 6 is a plan view of the end post illustrated in FIG. 5.
Figure 7:
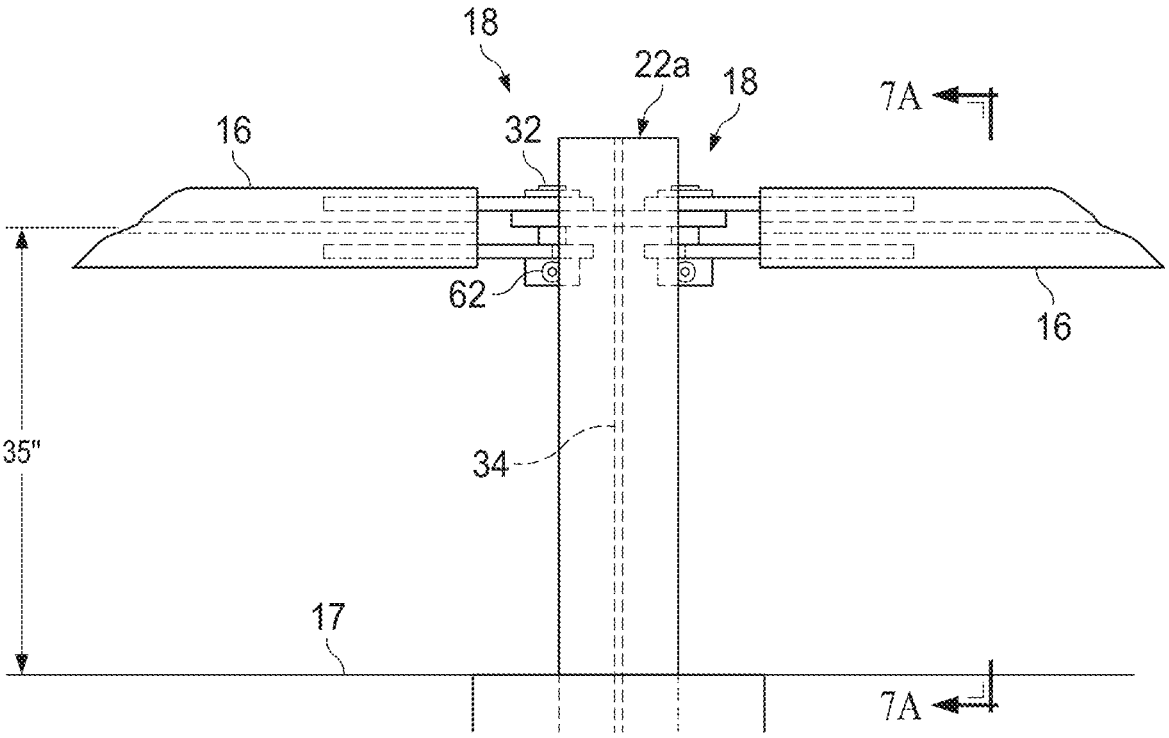
FIG. 7 illustrates an exemplary crash post and beam connection according to aspects of the disclosure.
Figure 7A:
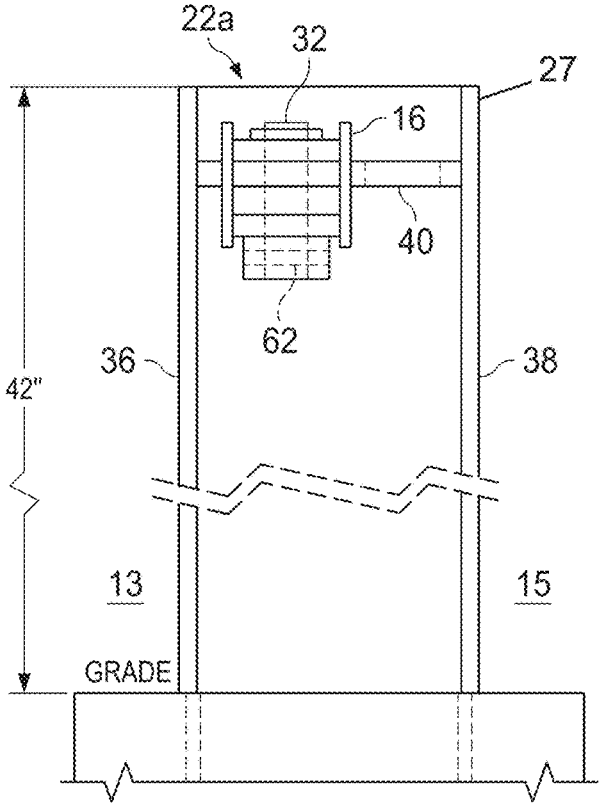
FIG. 7A illustrates a view along the line 7A-7A in FIG. 7.
Figure 7B:
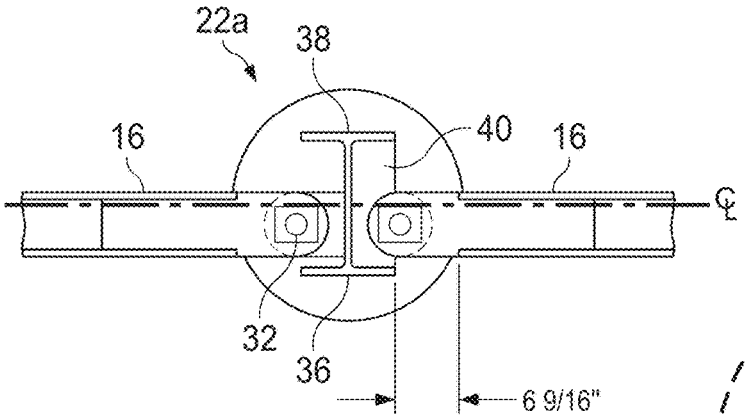
FIG. 7B is a plan view of the exemplary crash post and beam connection of FIG. 7.
Figure 7C:
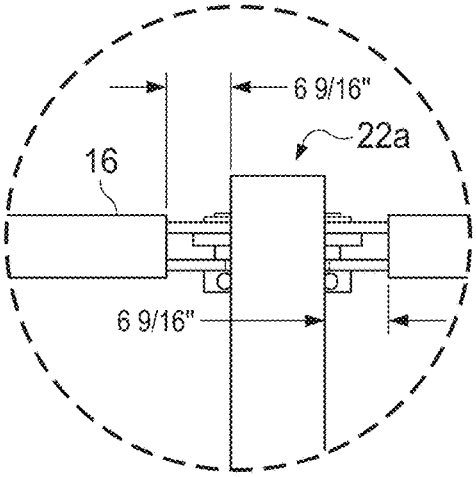
FIG. 7C is an expanded view of the exemplary crash post and beam connection of FIG. 7.

FIGS. 1 and 2 illustrate a linear section of AVB 10 extending between opposing end posts 22*b* that meets the M50-P1 crash testing criteria under ASTM F2656. The terminal ends 20 of a linear section of beam 12 are connected to the respective end posts 22*b*. An example end post 22*b* is illustrated in FIGS. 4-6. A corner end post, although not shown, may be similarly configured for beam sections to extend in two different directions. As will be understood by those skilled in the art with the benefit of this disclosure, connection joints 18 (e.g., beam to crash or end post, or beam to beam) may allow vertical movement of the interconnected elements relative to one another to accommodate grade changes along the length of the barrier. In the illustrated example, the height from grade to beam center is 35 inches+/−3 inches for grade change between crash posts 22*a*. In some embodiments, beam 12 can accommodate a grade change of about 11 degrees at connection joints 18 providing a maximum grade change of 22 degrees at each crash post 22*a*. The concrete foundation is a minimum 3500 psi, and in an example, reinforced with No. 3 and No. 5 rebar. In the illustrated example of an M50-P1 barrier, the spacing between adjacent crash posts 22*a* is approximately 28 feet and the beams sections 16 are interconnected at crash posts 22*a*. For reference, a single connector plate is referred to as a male connector, or male end, and a double connector plate arrangement is referred to as a female connector or a female end. In an exemplary AVB 10, beam sections 16 may be constructed for example of W6×25 or W6×20 beams, end posts 22*b* of HSS (hollow square sections) of 12"×12"×0.5" ASTM A36 steel tube, crash posts 22*a* of W14×61 beams, and the various connector plates 28, 40, 54 by 1-to-1.5-inch ASTM A572 Gr. 50 steel plate.

In the embodiment of FIGS. 1 and 2, AVB 10 includes trusses 14 and end posts 22*b*. With additional reference to FIGS. 3, 4, 4A, and 4B, trusses 14 include a kicker brace 24 that extends from end post 22*b* substantially in-line with beam 12, and below beam 12, to a foundation post 26. In an exemplary embodiment, kicker brace 24 may be constructed of W6×25 or W6×20 beam and foundation brace post 26 of 8"×8"×0.375" tubular steel. As illustrated for example in FIGS. 1 and 2, truss kicker brace 24 and foundation post 26 are located substantially vertically below beam 12 as opposed to extending laterally away from the longitudinal axis of beam 12. In some embodiments, AVB 10 may not include a kicker brace (e.g., truss) at end post 22*b*. For example, a post and beam AVB 10 constructed in according to aspects of FIGS. 1 and 2, with the exception of an end section kicker brace, or truss, may achieve a rating below M50-P1 rating, such as a M50-P2, M50-P3, M40-P1, M40-P2, M40-P3, M30-P1, M30-P2, or M30-P3 rating.

Figure 4A:
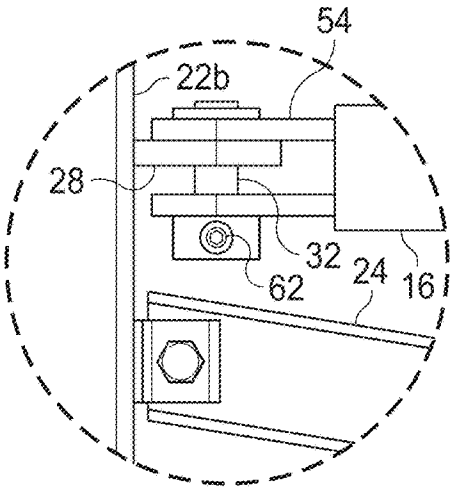
FIG. 4A is an expanded view of a portion of the truss section of FIG. 4.

FIGS. 5 and 6 illustrate an exemplary embodiment of an end post 22*b*. End post 22*b* is constructed, for example, of 12"×12"×0.5" structural steel. A connector plate 28 is directly attached to end post 22*b*. Connector plate 28 includes a vertical hole 30 for disposing a pin 32 such as illustrated in FIG. 4A. In this example, connector plate 28 is a 1.25-inch-thick steel plate.

FIGS. 7, 7A-C, 8, 8A-B, 9, and 9A-B illustrate the connection of adjacent beams sections 16 (e.g., FIGS. 10-13) at a crash post 22*a*. This connection of beam sections 16 at joints 18 to crash post 22*a* are configured for example to meet the M50-P1 crash test rating. The illustrated crash posts 22*a* provide beam connection joints 18 on opposite sides of crash post 22*a* (e.g., opposite sides of beam web 34). Crash post 22*a* is secured in the ground and oriented such that beam web 34 extends perpendicular to the longitudinal axis of beam sections 16 with an attack side flange 36 located on attack side 13 of AVB 10 and asset side flange 38 positioned on asset side 15 of AVB 10. Adjacent beam sections 16 are connected to crash post 22*a* and to each other through a beam connector plate 40, also referred to as a beam-post connector plate 40. In this example, beam-post connector plate 40 is a steel plate (e.g., 1 to 1.5 inches thick) having spaced apart pin holes 30, illustrated individually as holes 30*a*, 30*b* in which pins can be disposed to connect beam sections 16 to the connector plate. Joint 18 can also permit vertical displacement of the connected members relative to one another to account for grade level changes along the length of AVB 10.

Figure 8:
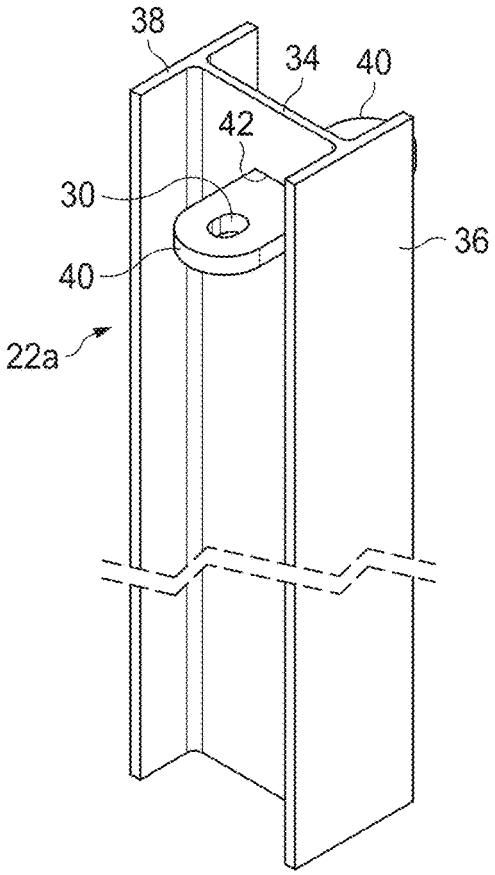
FIG. 8 is a perspective view of an exemplary crash post according to aspects of the disclosure.
Figure 8A:
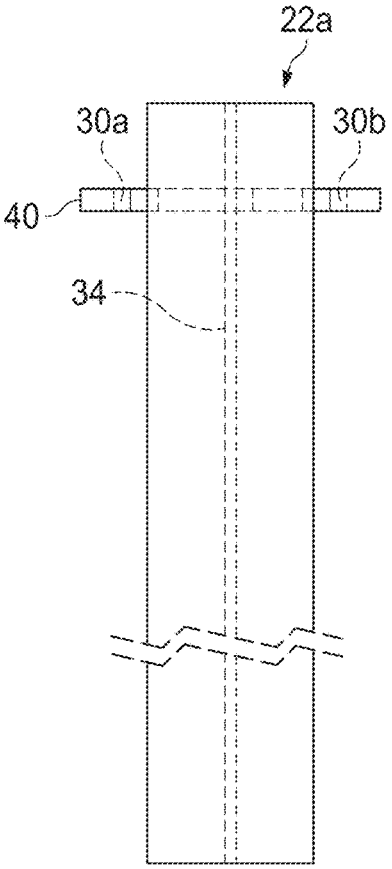
FIG. 8A is a side view of the exemplary crash post of FIG. 8.
Figure 8B:
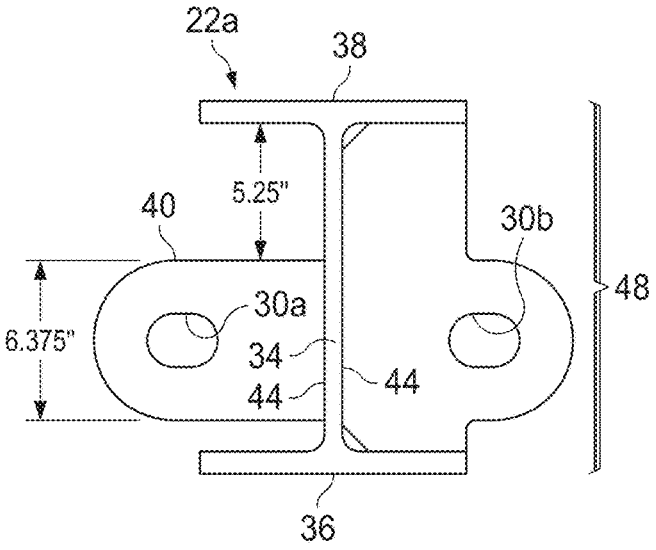
FIG. 8B is a plan view of the exemplary crash post of FIG. 8.
Figure 9:
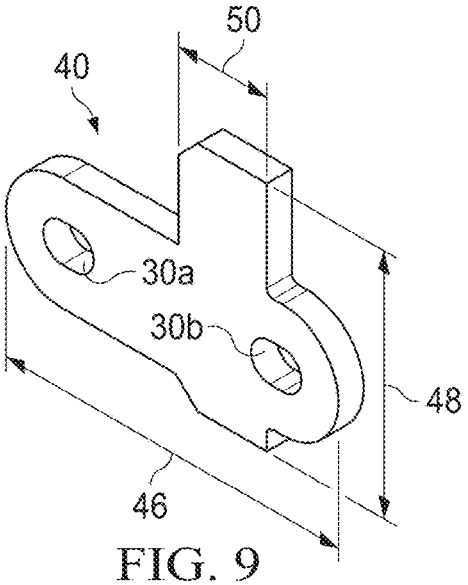
FIG. 9 is a perspective view of an exemplary crash post connector plate according to aspects of the disclosure.
Figure 9A:
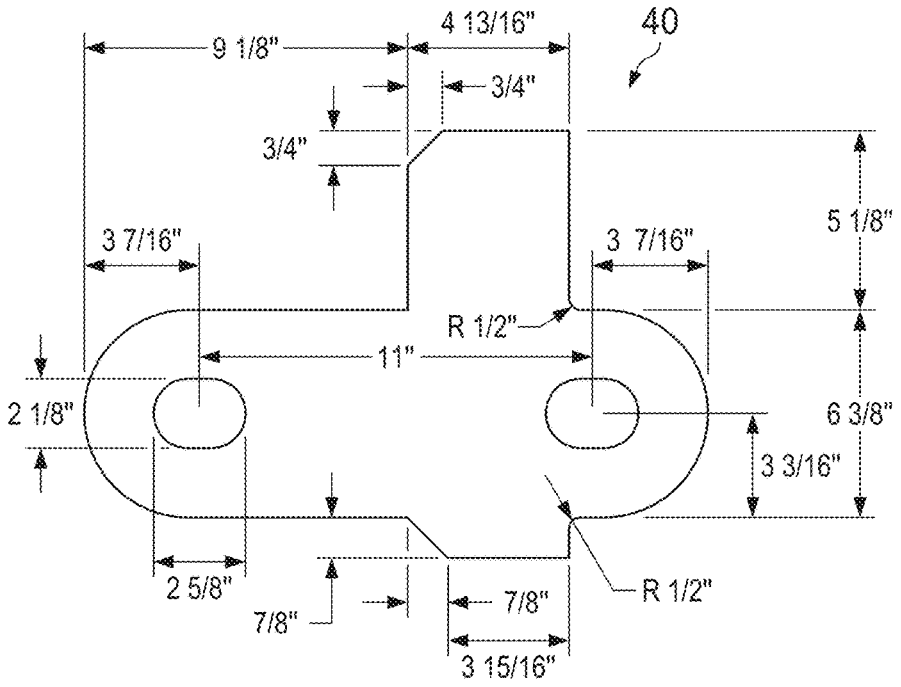
FIGS. 9A and 9B illustrate an exemplary embodiment of the crash post connector plate according to FIG. 9.
Figure 9B:
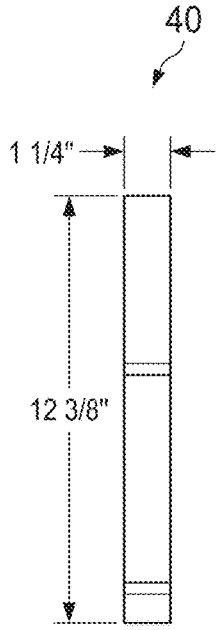
Figure 10:
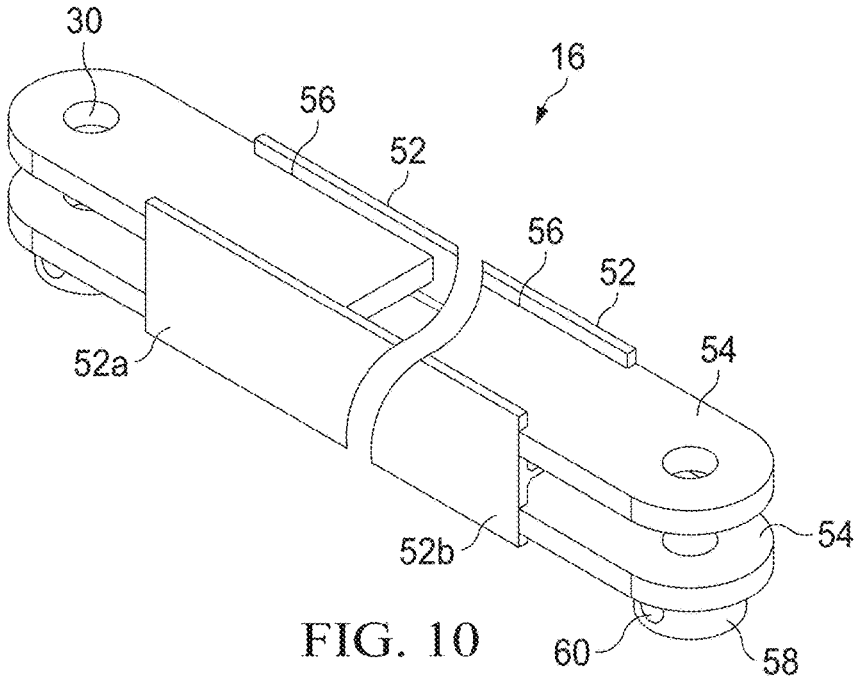
FIG. 10 is a perspective view of an exemplary beam section according to aspects of the disclosure.
Figure 11:
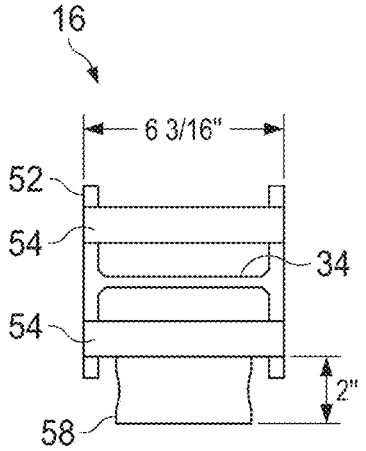
FIG. 11 is an end view of an exemplary beam section according to aspects of the disclosure.
Figure 12:
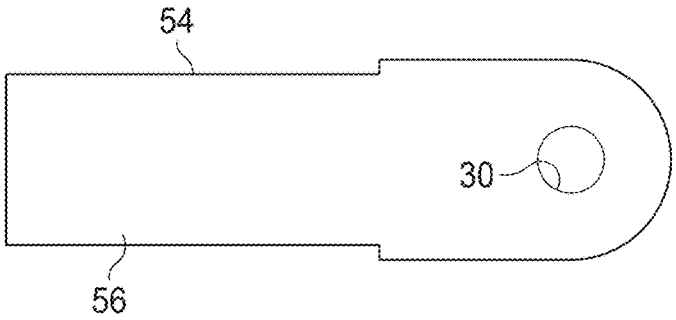
FIG. 12 illustrates an exemplary beam section connector plate according to aspects of the disclosure.
Figure 13:
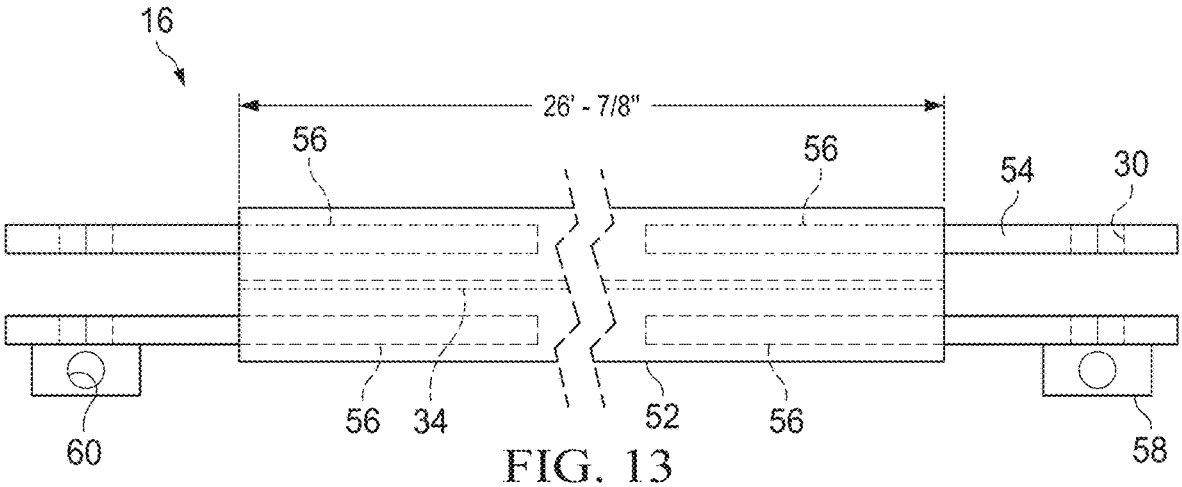
FIG. 13 is a side view of another exemplary beam section according to aspects of the disclosure.
Figure 20:
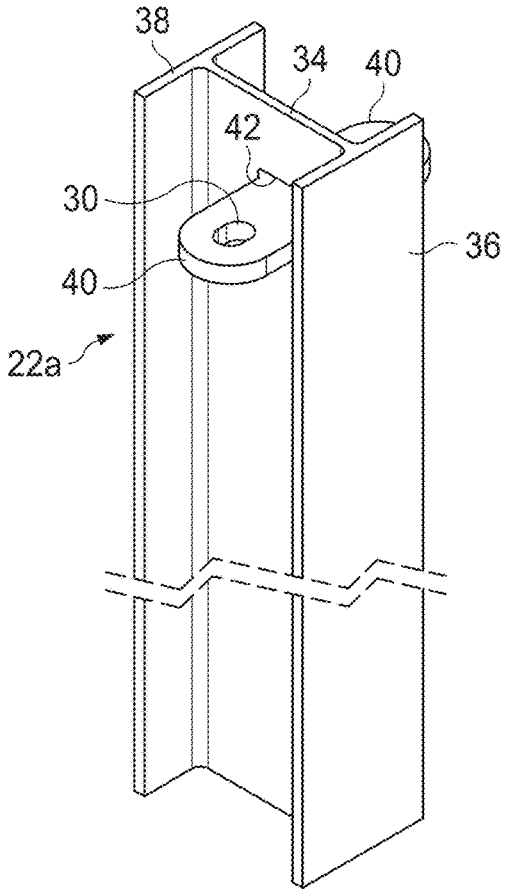
FIG. 20 is a perspective view of another exemplary crash post according to aspects of the disclosure.
Figure 20A:
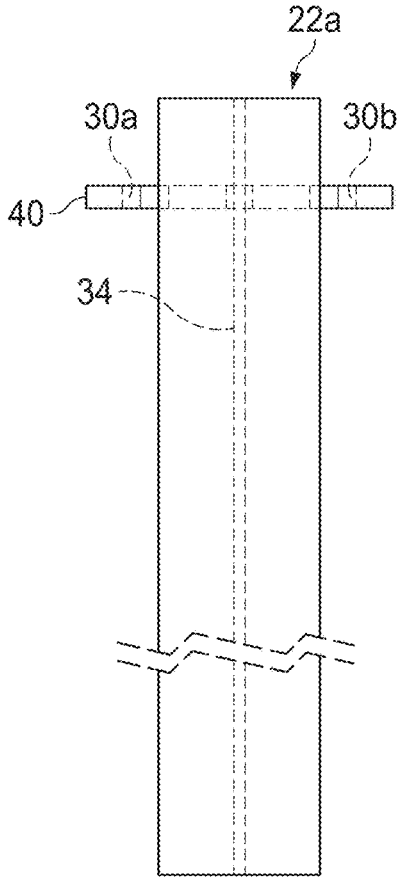
FIG. 20A is a side view of the exemplary crash post of FIG. 20.
Figure 20B:
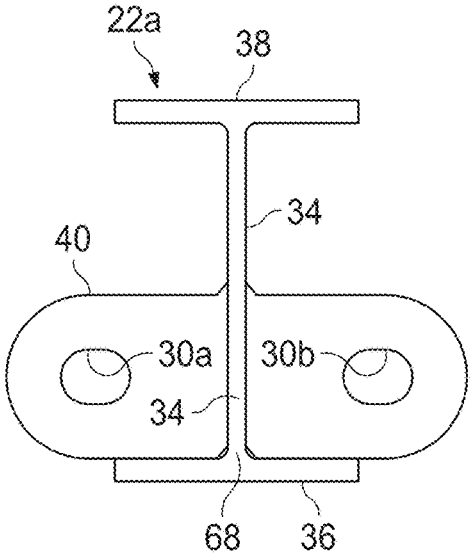
FIG. 20B is a plan view of the exemplary crash post of FIG. 20.
Figure 21:
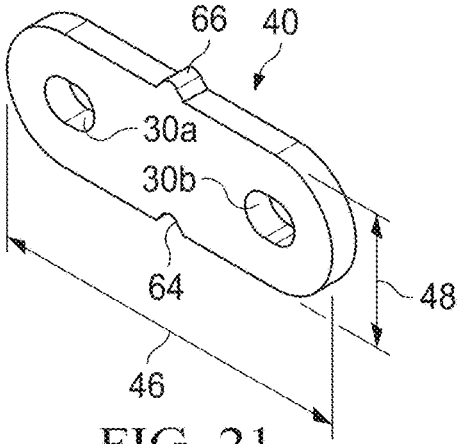
FIG. 21 is a perspective view of another exemplary crash post connector plate according to aspects of the disclosure.
Figure 21A:
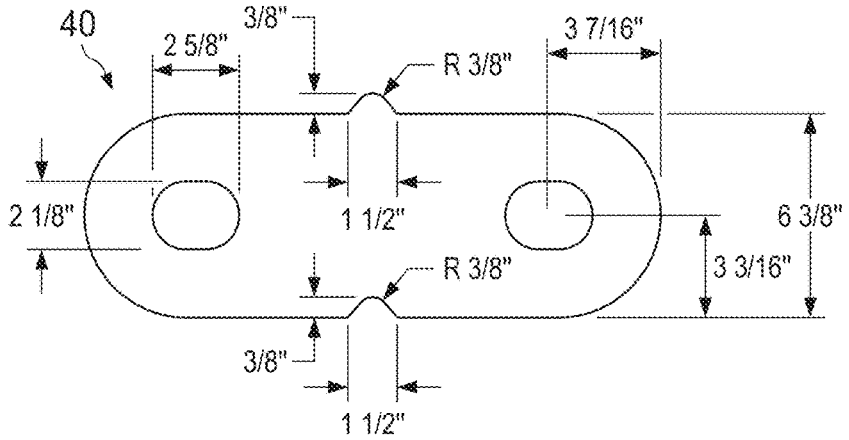
FIGS. 21A and 21B illustrate an exemplary embodiment of the crash post connector plate according to FIG. 21.
Figure 21B:
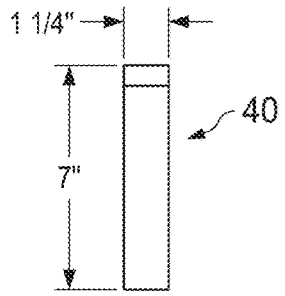

In the illustrated example, beam-post connector plate 40 is a unitary (single structure) that extends through a slot 42 in web 34 proximate to the top end 27 of post 22*a*, and is welded 44 to web 34, positioning pin holes 30*a*, 30*b* that are spaced apart along a longitudinal span 46 on opposite sides of web 34, see, e.g., FIGS. 8A-B, 9. Using two or more connector plates will not depart from the scope of this disclosure. Longitudinal span 46 extends substantially coaxially with the longitudinal axis of the continuous beam. In the illustrated examples, pin holes 30 are located closer to attack side flange 36 than to asset side flange 38 and are located longitudinally outside of the ends of crash post flanges 36, 38. In this embodiment, beam-post connector plate 40 has a lateral span 48 extending perpendicular to longitudinal span 46 and having a length approximately equal to the length of web 34 of crash post 22*a* and lateral span 48 has a width 50 (FIG. 9) proximate to one-half of the flange, i.e., the length of the flange from the web to the outer end of the flange such that lateral span 48 substantially matches and fills the cross-section area defined between the attack flange 36, asset flange 38, and web 34 (FIG. 8B). Thus, beam connector plate 40 fills the cross-sectional area of crash post 22*a* on one side of web 34 and on the opposite side of web 34 beam connector plate 40 does not extend the complete lateral distance between flanges 36, 38. In a less-than M50-P1 crash rating embodiment, see, e.g., FIG. 20B), beam-post connector plate 40 may not have a lateral span 48 that extends the full distance between crash post flanges 36, 38.

In the M50-P1 rated AVB embodiment illustrated in particular in FIGS. 1 and 2, the individual beam sections 16 are connected together at crash posts 22*a* and not interconnected at intermediate positions between crash posts 22*a* as may be performed in some embodiments. For example, AVB 10, illustrated in FIGS. 14 and 15, includes joints 18 that are positioned at intermediate positions in the beam span between crash posts 22*a*, see, e.g., FIG. 19.

FIGS. 10-13 illustrate exemplary beam sections 16. Beam section 16 includes an I-beam 52 having one or more connector plates 54, e.g., warp plates, positioned at opposing ends 52*a*, 52*b*. Each warp plate 54 includes a warp end 56 in direct contact with I-beam 52 and a vertical hole 30 for positioning a pin 32 as shown for example in FIGS. 7 and 7A. Beam section 16 illustrated in FIGS. 10, 11 and 13, includes two vertically separated connector plates 54 at each end 52*a*, 52*b* and may, therefore, be referred to as a female-female beam section. In the illustrated exemplary beam sections 16, a metal housing 58 is attached on the bottom end of the lower connector plate 54 below vertical holes 30. Housing 58 may have lateral opening 60 to align with a cross-hole in the pins to pass a bolt to lock the pin in position. For example, with reference to FIGS. 7 and 7A, a pin 32 is disposed in beam connector plates 54 and crash post connector plate 40 to form a pivotal joint 18 allowing relative rotational movement between pin 32 and at least one connector plates 40, 54. A cross-pin 62, such as a carriage bolt, is positioned through lateral opening 60 into pivot pin 32 to lock the pin in place and prevent unauthorized removal.

Figure 14:
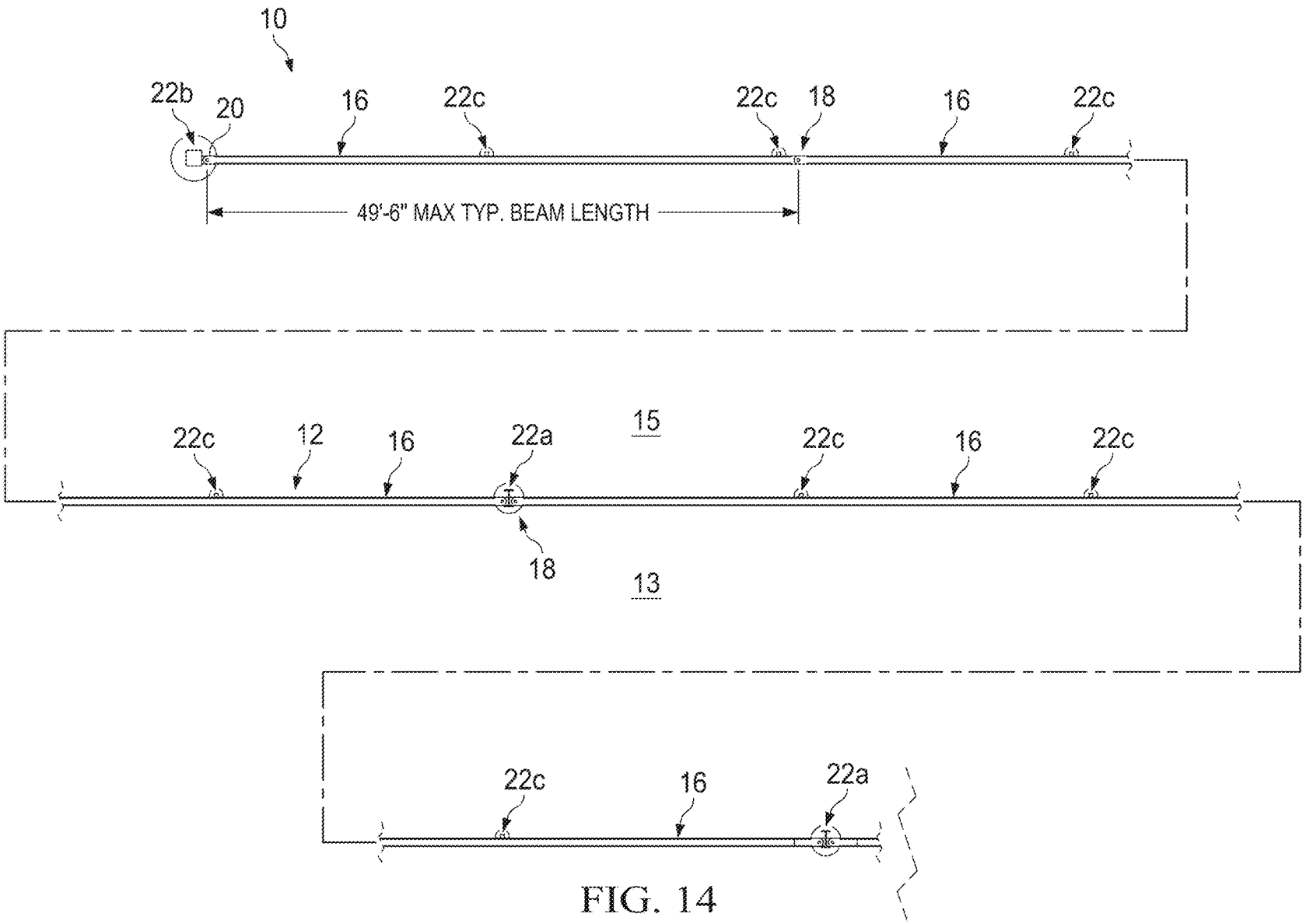
FIG. 14 is a plan view of a section of an exemplary anti-ram vehicle barrier according to aspects of the disclosure.
Figure 15:
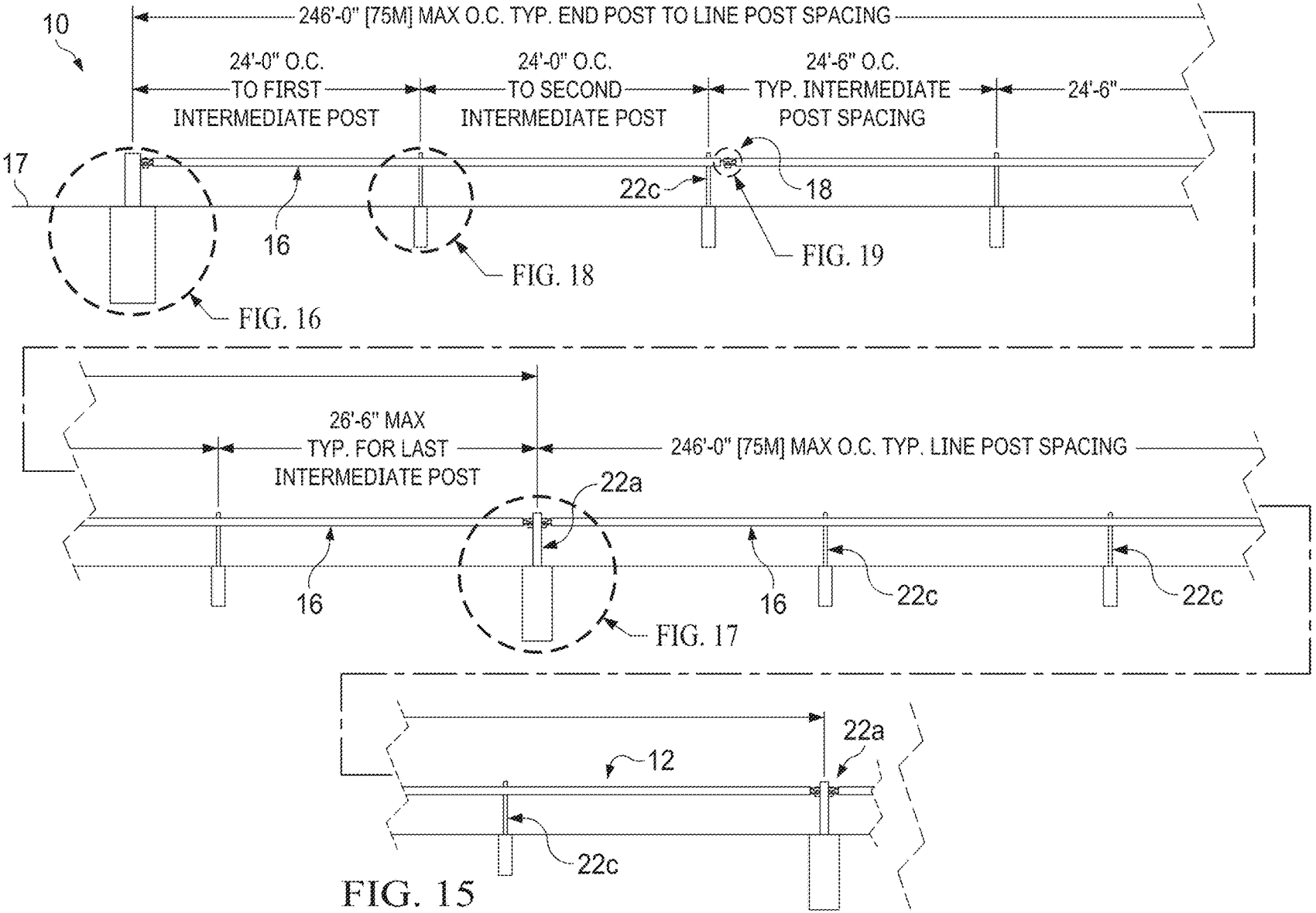
FIG. 15 is an elevation view of a portion of the exemplary anti-ram vehicle barrier of FIG. 14.
Figure 16:
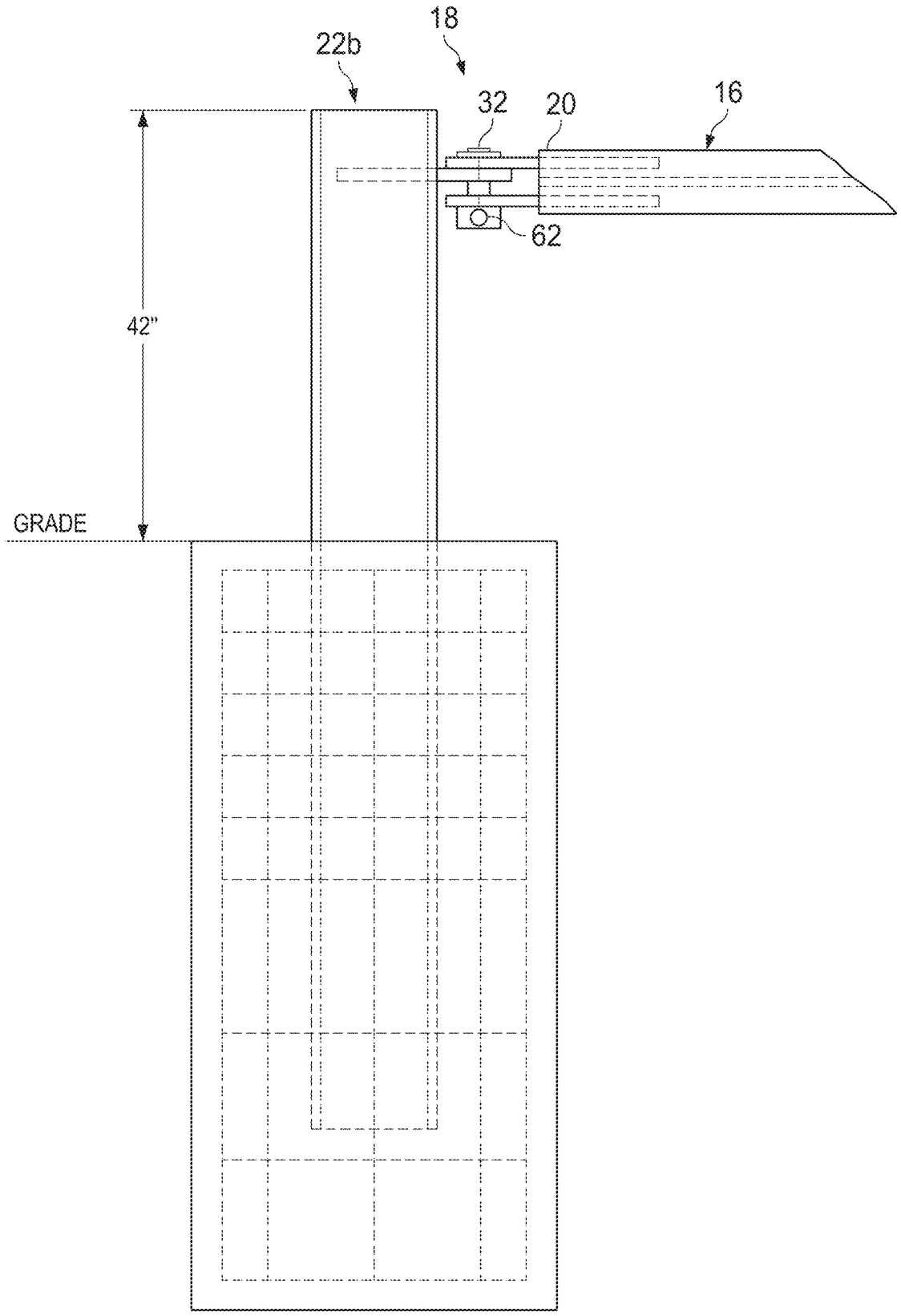
FIG. 16 illustrates another exemplary end post to beam connection according to aspects of the disclosure.
Figure 17:
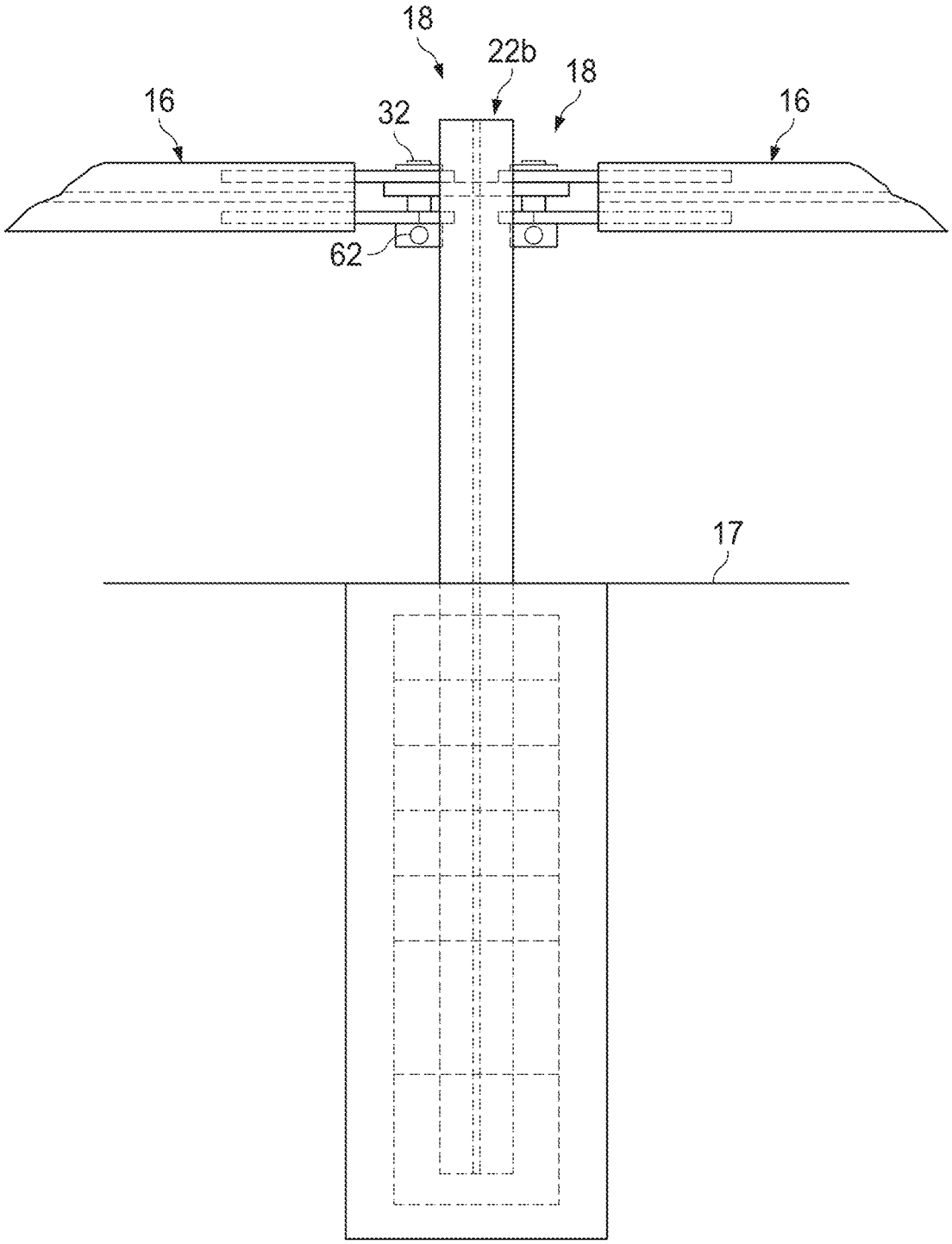
FIG. 17 illustrates an exemplary crash post and beam connection according to aspects of the disclosure.
Figure 18:
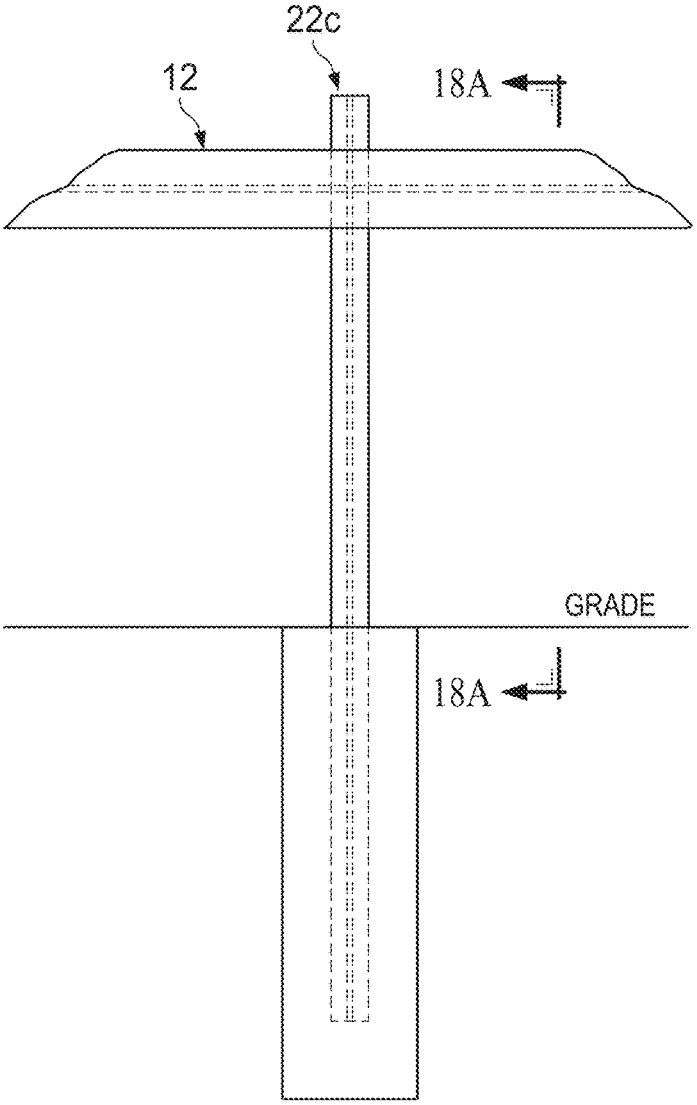
FIG. 18 illustrates an exemplary intermediate post to beam connection according to aspects of the disclosure.
Figure 18A:
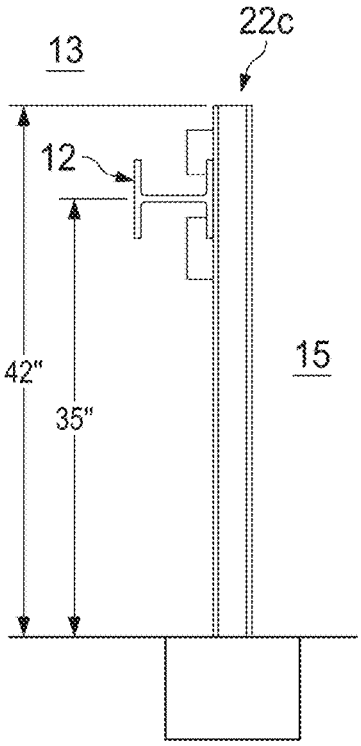
FIG. 18A is a side view of the intermediate post to beam connection illustrated in FIG. 18.
Figure 19:
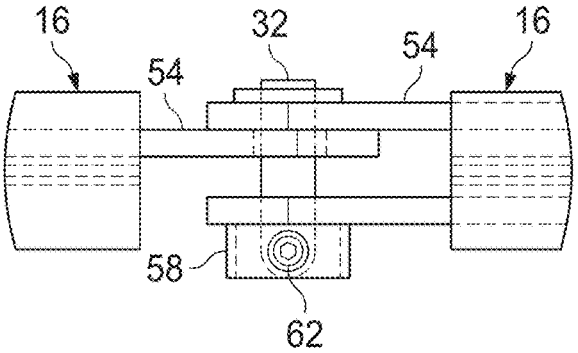
FIG. 19 illustrates an exemplary direct connection of adjacent beam sections according to aspects of the disclosure.

FIGS. 14 and 15 illustrate a linear section of an exemplary post and beam type anti-ram vehicle barrier (AVB) 10. AVB 10 includes a continuous longitudinally extending beam 12 formed by a plurality of interconnected beam sections 16 extending between opposing end posts 22*b*. The terminal ends 20 of a linear section of beam 12 are connected to end posts 22*b* by pivotal connections 18. AVB 10 illustrated in FIGS. 14 and 15 is configured to meet for example the M40-P2 crash testing criteria under ASTM F2656. An example end post 22*b* is illustrated in FIG. 16. A kicker brace is not connected to end post 22*b* as used in the embodiment illustrated in FIGS. 1 and 2. A corner end post, although not shown, may be similarly configured for beam sections to extend in two different directions. As will be understood by those skilled in the art with the benefit of this disclosure, the connection points (joints 18) may allow for vertical movement of the interconnected elements to accommodate grade changes along the length of AVB 10. In the illustrated example, the height from grade to beam center is 35 inches+/−3 inches for grade changes between crash posts. In some embodiments, beam 12 can accommodate a grade change of about 11 degrees at each connection 18 providing a maximum grade change of 22 degrees at crash posts 22*a* (connections 18 on each side of the crash post). The concrete foundation is a minimum 3500 psi, and in an example, reinforced with No. 3 and No. 5 rebar. The spacing between adjacent crash posts 22*a* is approximately 246 feet in the illustrated exemplary M40-P2 rated AVB 10. Beam sections 16 are interconnected by pivotal connections 18 at crash posts 22*a* (FIG. 17), at end post 22*b* (FIG. 16), and at intermediate positions within the beam span between adjacent crash posts 22*a* (FIG. 19). In some embodiments, crash posts 22*a* and end posts 22*b* are located in the same vertical plane as the longitudinally extending beam 12. Intermediate post 22*c* may be located in a different vertical plane, i.e., in front of or behind, then beam 12. For reference, a single connector plate is referred to as a male connector or male end, and a double connector plate arrangement is referred to as a female connector or a female end. Intermediate posts 22*c* may also be connected to beam 12 between adjacent pivotal connections 18 (see, e.g., FIGS. 18, 18A). As shown in FIG. 18A, intermediate post 22*c* is located in a different vertical plane from beam 12. Intermediate post 22*c* is located in a vertical plane on asset side 15 of the vertical plane of beam 12. The individual beam sections 16 (FIG. 23) may have a longer length than the individual beam sections used in other crash test rating or not rated embodiments.

In an exemplary AVB 10, beam sections 16 (e.g., FIGS. 23-25) may be constructed of W6×25 or W6×20 beams, crash posts 22*a* constructed of W14×61, W14×30, or W14×38 beams, end posts 22*b* by HSS (hollow square sections) of 12"×12"×0.5" ASTM A36 steel tube, intermediate posts 22*c* of W13×5.7 beams, and various connector plates 28, 40, 54 constructed of 1-to-1.5-inch ASTM A572 Gr. 50 steel plate.

Another difference between exemplary AVB 10 illustrated in FIGS. 14 and 15 and exemplary AVB 10 illustrated in FIGS. 1 and 2, is the connection of adjacent beam sections 16 at crash post 22*a*. An exemplary pivotal connection 18 of beam sections 16 to a crash post 22*a* is described with reference to FIGS. 20, 20A, 20B, 21, 21A, 21B, and 22.

Crash posts 22*a* provide beam pivotal connection points on opposite sides of crash post 22*a* (opposite sides of beam web 34). Crash post 22*a* is secured in the ground and oriented such that web 34 extends perpendicular to the longitudinal axis of beam 12 with an attack side flange 36 located on attack side 13 of AVB 10 and asset side flange 38 positioned on asset side 15 of AVB 10. In the illustrated examples, beam connector plate 40 is a steel plate (e.g., 1 to 1.5 inches thick) having pin hole 30 in which a pin 32 (see, e.g., FIG. 17) is disposed to connect beam sections 16 to beam connector plate 40. In the illustrated example, beam connector plate 40 is a unitary (single structure) that extends through a slot 42 in web 34 and is welded to web 34, positioning pin holes 30*a*, 30*b* on opposite sides of web 34, see, e.g., 20A, 20B. Using two or more connector plates will not depart from the scope of this disclosure. In the illustrated examples, pin holes 30 are located closer to attack side flange 36 than to asset side flange 38 and are located longitudinally outside of the ends of crash post flanges 36, 38.

Figure 22:
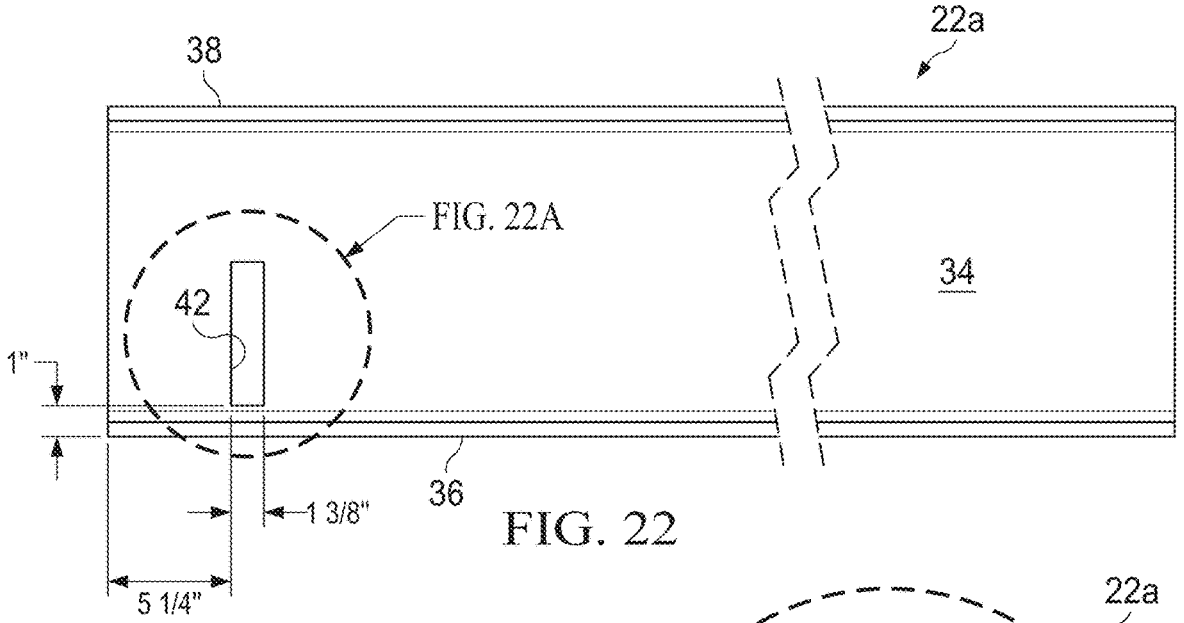
FIG. 22 illustrates an exemplary crash post according to aspects of the disclosure.
Figure 22A:
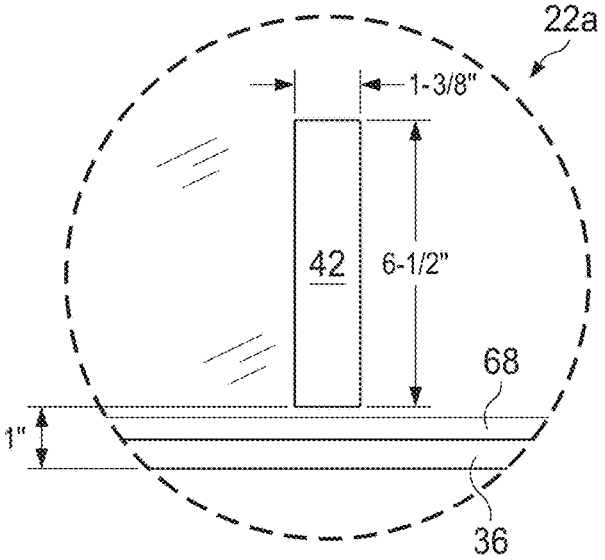
FIG. 22A illustrates an expanded view of a portion of the crash post of FIG. 22.

With reference to FIGS. 22 and 22A, a slot 42 is formed in web 34 of crash post 22*a* extending from proximate to attack side flange 36 and terminating in this example less than the mid-point of web 34. Beam connector plate 40 (FIGS. 21, 21A, 21B), which is a unitary structure in this example, has a longitudinal span 46 that extends a length greater than the length of the crash post flanges 36, 38 and pin holes 30 are spaced apart on along longitudinal span 46. Longitudinal span 46 extends substantially co-axially with the longitudinal axis of AVB 10. In this example, the length of lateral span 48, extending perpendicular to longitudinal span 46, is substantially constant along the length of longitudinal span 46 and the length of lateral span 48 is less than the length of web 34.

Beam connector plate 40 includes an indentation 64 and a tang 66 located on opposite edges of lateral span 48 and proximate to the mid-point along longitudinal span 46. Indentation 64 and tang 66 serve to position beam connector plate 40 relative to web 34 of crash post 22*a*. Indentation 64 is sized to dispose the flange-to-web taper 68 (FIG. 20B, 22A) on attack side flange 36 and tang 66 adds the material and width removed by indentation 64. Once positioned, beam connector plate 40 may be, for example, welded in place.

Figure 23:
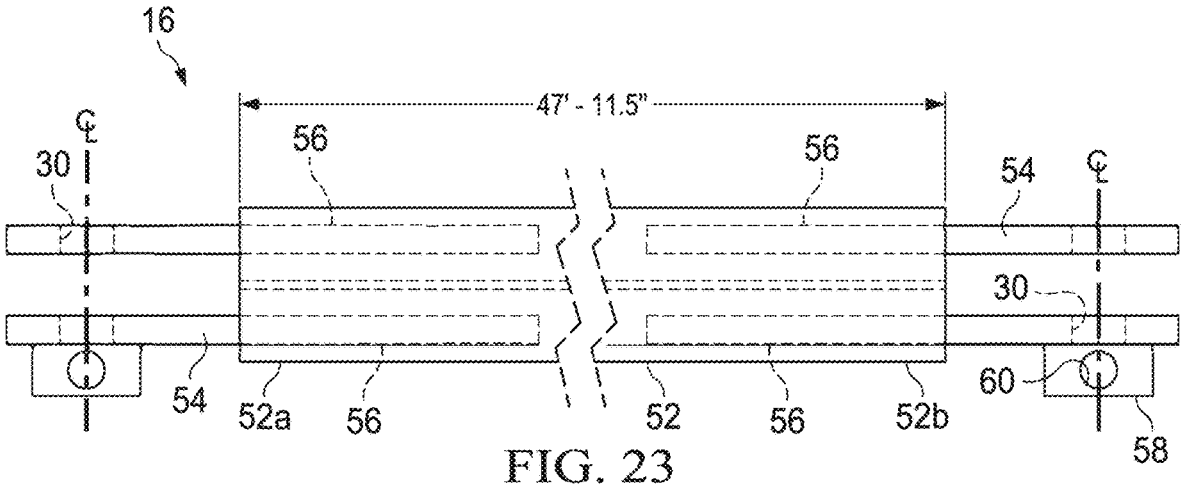
FIG. 23 is a side view of another exemplary beam section according to aspects of the disclosure.
Figure 24:
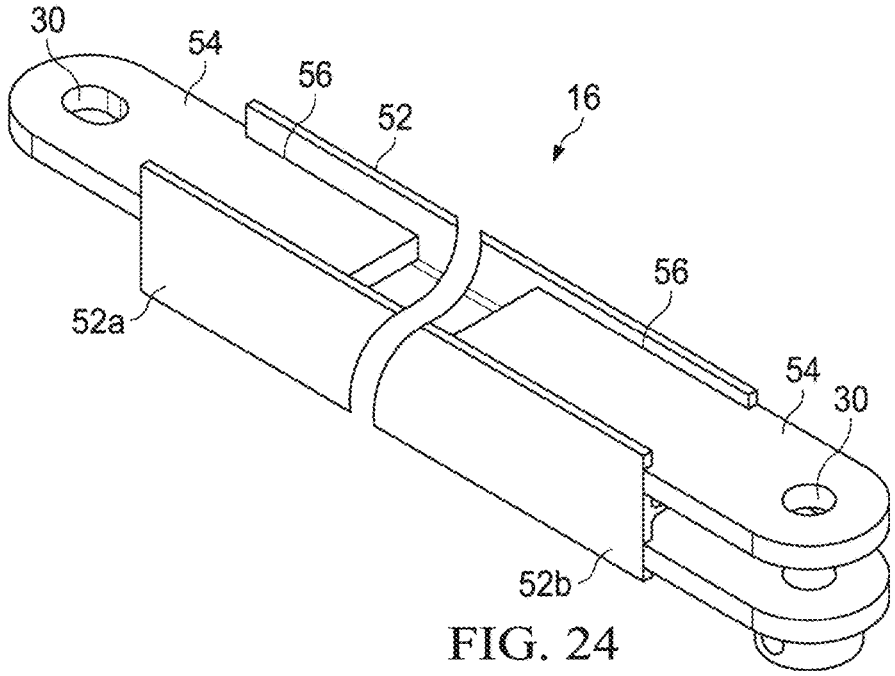
FIG. 24 is a perspective view of another exemplary beam section according to aspects of the disclosure.
Figure 25:
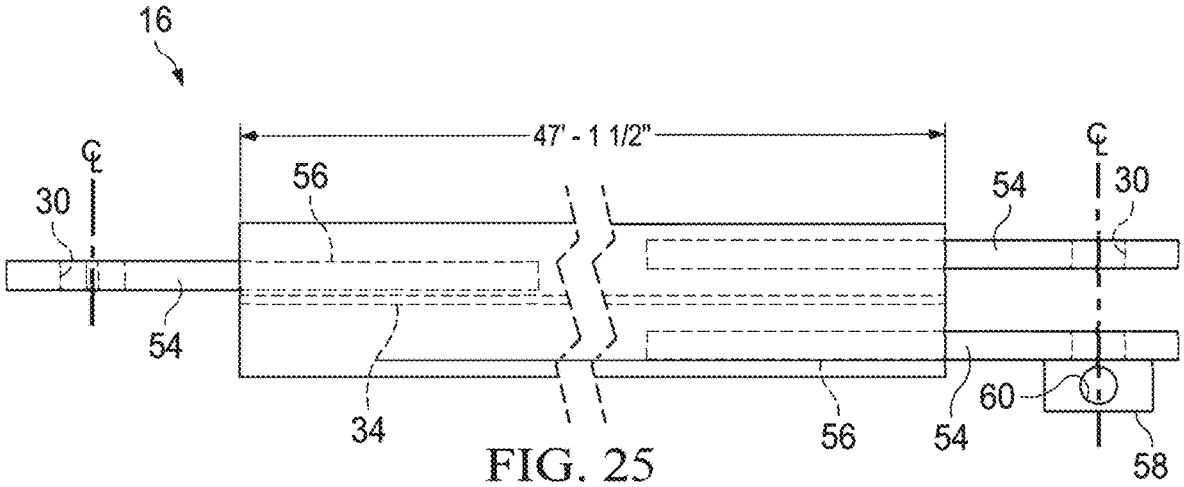
FIG. 25 is a side view of another exemplary beam section according to aspects of the disclosure.

FIGS. 23-25 illustrate exemplary beam sections 16. Beam section 16 includes an I-beam 52 having one or more connector plates 54, e.g., warp plates, positioned at opposing ends 52*a*, 52*b*. Each warp plate 54 includes a warp end 56 in direct contact with I-beam 52 and a vertical hole 30 for positioning a pin 32 as shown for example in FIGS. 16, 17, and 19. Beam section 16 illustrated in FIG. 23 includes two vertically separated connector plates 54 at each end 52*a*, 52*b* and may, therefore, be referred to as a female-female beam section. FIGS. 24 and 25 illustrate a female-male beam section 16. In the illustrated exemplary beam sections 16, a metal housing 58 is attached on the bottom end of the lower connector plate 54 below vertical hole 30. Housing 58 may have a lateral opening 60 to align with a cross-hole in the pins to pass a bolt to lock the pin in position. For example, with reference to FIGS. 16, 17, and 19, a pin 32 is disposed in the connector plates to form a pivotal joint 18. A cross-pin 62, such as a carriage bolt, is positioned through lateral opening 60 into pin 32 to lock the pin in place and prevent unauthorized removal.

An exemplary method for creating a vehicle barrier includes installing a longitudinally extending beam positioned vertically above a ground level and separating an asset side from an attack side, the beam comprising beam sections a crash post positioned in a same vertical plane as the beam, wherein adjacent beam sections are pivotally connected to the crash post. The method may also include crash testing the vehicle barrier by ramming a vehicle traveling in a direction from the attack side toward the asset side into the beam.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements and/or states. Thus, such conditional language is not generally intended to imply that features, elements and/or states are in any way required for one or more embodiments or that one or more embodiments necessarily include such elements or features.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A beam-to-post connection in a vehicle barrier comprising:

an upstanding post having a top end and a planar wall;

a barrier beam extending longitudinally in a same vertical plane as the post and separating an attack side from an asset side;

a first beam section of the barrier beam attached to the post on a first side of the post by a first post connection;

the first post connection comprising a first beam plate extending from an end of the first beam section, a first post plate extending from the planar wall proximate the top end, and a first pin vertically disposed in the first beam plate and the first post plate;

a second beam section of the barrier beam attached to the post on a second side of the post by a second post connection; and the second post connection comprising a second beam plate extending from an end of the second beam section, a second post plate extending from the planar wall proximate the top end, and a second pin vertically disposed in the second beam plate and the second post plate:

wherein the first post plate and the second post plate are sections of a single metal member extending through the planar wall with a first hole in the first post plate positioned on the first side and a second hole in the second post plate positioned on the second side.

2. The beam-to-post connection of claim 1, wherein the first post connection allows relative rotational movement between the first pin and at least one of the first beam plate or the first post plate.

3. The beam-to-post connection of claim 1, wherein the first post connection allows vertical movement of the first beam section relative to the post.

4. The beam-to-post connection of claim 1, wherein the first post connection allows vertical movement of the first beam section relative to the post and relative rotational movement between the first pin and at least one of the first beam plate or the first post plate.

5. The beam-to-post connection of claim 1, wherein the first post connection further comprises:

a lower first beam plate extending from the end of the first beam section and located below the first beam plate;

the first post plate positioned between the first beam plate and the first lower beam plate; and the first pin vertically disposed in the first beam plate, the first lower beam plate, and the first post plate.

6. The beam-to-post connection of claim 5, wherein the first post connection allows relative rotational movement between the first pin and at least one of the first beam plate, the first lower beam plate, or the first post plate.

7. The beam-to-post connection of claim 5, wherein the first post connection allows vertical movement of the first beam section relative to the post.

8. The beam-to-post connection of claim 5, wherein the first post connection allows vertical movement of the first beam section relative to the post and relative rotational movement between the first pin and at least one of the first beam plate, the first lower beam plate, or the first post plate.

9. The beam-to-post connection of claim 1, wherein:

the first beam section comprises a central web connecting an attack-side flange to an asset-side flange; and the post comprises a first flange and a second flange and the planar wall is a web connecting the first flange to the second flange.

10. The beam-to-post connection of claim 9, wherein the first post connection further comprises:

a lower first beam plate extending from the end of the first beam section and located below the first beam plate;

the first post plate positioned between the first beam plate and the first lower beam plate; and the first pin vertically disposed in the first beam plate, the first lower beam plate, and the first post plate.

11. The beam-to-post connection of claim 10, wherein the first beam plate and the first lower beam plate are located on opposite sides of the central web.

12. The beam-to-post connection of claim 10, wherein the first post connection allows vertical movement of the first beam section relative to the post.

13. The beam-to-post connection of claim 1, wherein:

the post comprises a first flange and a second flange and the planar wall is a web connecting the first flange to the second flange;

the first post plate extends on the first side between the first flange and the second flange; and the second post plate extends on the second side between the first flange and the second flange.

14. The beam-to-post connection of claim 13, wherein the first beam section comprises a central web connecting an attack-side flange to an asset-side flange.

15. A vehicle barrier comprising:

a first post and a second post each having a top end, and a web connecting a first flange to a second flange;

a barrier beam extending longitudinally in a same vertical plane as the first post and the second post, the barrier beam separating an attack side from an asset side, and the barrier beam comprising a central web connecting an attack-side flange and an asset-side flange;

a first post connection attaching the barrier beam to the first post, the first post connection comprising a first beam plate and a first lower beam plate extending from a first end of the barrier beam, a first post plate in direct connection to the web of the first post and extending between the first flange and the second flange, the first post plate positioned between the first beam plate and the first lower beam plate, and a first pin vertically disposed in the first beam plate, the first post plate, and the first lower beam plate; and a second post connection attaching the barrier beam to the second post.

16. The vehicle barrier of claim 15, wherein the first post connection allows vertical movement of the barrier beam relative to the first post.

17. The vehicle barrier of claim 15, wherein the barrier beam is a single metal member.

18. The vehicle barrier of claim 15, wherein the vehicle barrier has an M50 P1 designation in accordance with ASTM F2656.

19. The vehicle barrier of claim 15, wherein:

the first post connection allows vertical movement of the barrier beam relative to the first post; and the barrier beam is a single metal member.

20. The vehicle barrier of claim 19, wherein the vehicle barrier has an M50 P1 designation in accordance with ASTM F2656.

21. A beam-to-post connection in a vehicle barrier comprising:

a post having a top end and a web connecting a first flange to a second flange;

a barrier beam extending longitudinally in a same vertical plane as the post and separating an attack side from an asset side;

a first beam section of the barrier beam attached to the web on a first side of the web by a first post connection;

the first post connection comprising a first beam plate extending from an end of the first beam section, a first post plate in direct connection to the web and extending on the first side between the first flange and the second flange, and a first pin vertically disposed in the first beam plate and the first post plate;

a second beam section of the barrier beam attached to the web on a second side of the web by a second post connection; and the second post connection comprising a second beam plate extending from an end of the second beam section, a second post plate in direct connection to the web and extending on the second side between the first flange and the second flange, and a second pin vertically disposed in the second beam plate and the second post plate.

22. The beam-to-post connection of claim 21, wherein the first post connection further comprises:

a lower first beam plate extending from the end of the first beam section and located below the first beam plate;

the first post plate positioned between the first beam plate and the first lower beam plate; and the first pin vertically disposed in the first beam plate, the first lower beam plate, and the first post plate.

23. The beam-to-post connection of claim 21, wherein the first post plate and the second post plate are coaxial.

24. The beam-to-post connection of claim 23, wherein the first post connection further comprises:

a lower first beam plate extending from the end of the first beam section and located below the first beam plate;

the first post plate positioned between the first beam plate and the first lower beam plate; and the first pin vertically disposed in the first beam plate, the first lower beam plate, and the first post plate.

* * * * *